US012359812B2

(12) United States Patent
Vukanti et al.

(10) Patent No.: US 12,359,812 B2
(45) Date of Patent: Jul. 15, 2025

(54) GAS TURBINE ENGINE COMBUSTOR WITH OPENINGS

(71) Applicant: General Electric Company, Schenectady, NY (US)

(72) Inventors: Perumallu Vukanti, Bengaluru (IN); Sibtosh Pal, Mason, OH (US); Pradeep Naik, Bengaluru (IN); R Narasimha Chiranthan, Bengaluru (IN); Ajoy Patra, Bengaluru (IN); Michael T. Bucaro, Arvada, CO (US); Aritra Chakraborty, Bengaluru (IN); Arijit Sinha Roy, Bengaluru (IN); Pabitra Badhuk, Bengaluru (IN); Bhavya Naidu Panduri, Bengaluru (IN)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/663,324

(22) Filed: May 14, 2024

(65) Prior Publication Data

US 2024/0318822 A1 Sep. 26, 2024

Related U.S. Application Data

(63) Continuation of application No. 18/187,359, filed on Mar. 21, 2023, now Pat. No. 12,007,114.

(51) Int. Cl.
*F23R 3/06* (2006.01)

(52) U.S. Cl.
CPC ..... *F23R 3/06* (2013.01)

(58) Field of Classification Search
CPC ..... F23R 3/04; F23R 3/06
See application file for complete search history.

(56) References Cited

U.S. PATENT DOCUMENTS

| | | | | |
|---|---|---|---|---|
| 4,241,586 | A * | 12/1980 | Caruel | F23R 3/002 60/738 |
| 5,142,871 | A | 9/1992 | Lampes | |
| 10,488,046 | B2 | 11/2019 | Low et al. | |
| 10,591,162 | B2 | 3/2020 | Clemen | |
| 10,634,351 | B2 | 4/2020 | Bangerter et al. | |
| 10,760,436 | B2 | 9/2020 | Commaret et al. | |

(Continued)

OTHER PUBLICATIONS

European Office Action for application No. 24 151 097.3 dated Jun. 3, 2025, 6 pages.

*Primary Examiner* — Steven M Sutherland
(74) *Attorney, Agent, or Firm* — Carter, DeLuca & Farrell LLP; George Likourezos; Jason B. Scher

(57) ABSTRACT

A gas turbine engine includes a compressor section, a combustor section, and a turbine section in fore-to-aft serial flow arrangement and defines an engine centerline. The combustor section includes a combustor liner at least partially defining a combustor chamber and a dome wall, coupled to the combustor liner, and defining a forward end of the combustion chamber. A fuel nozzle is located on the dome wall and fluidly coupled to the combustion chamber. A first set of compressed air openings emit compressed air into the combustion chamber along a first flow path and a second set of compressed air openings emit compressed air into the combustion chamber along a second flow path. The first and second flow paths intersect at an intersection point to form a sheet of air.

12 Claims, 16 Drawing Sheets

(56) References Cited

U.S. PATENT DOCUMENTS

| | | | |
|---|---|---|---|
| 10,823,422 | B2 | 11/2020 | Johnson et al. |
| 11,143,407 | B2 | 10/2021 | Hoke et al. |
| 11,181,269 | B2 | 11/2021 | Boardman et al. |
| 11,199,326 | B2 | 12/2021 | Gringhaus et al. |
| 11,441,779 | B2 | 9/2022 | Ribassin et al. |
| 2017/0248314 | A1 | 8/2017 | Hannwacker et al. |
| 2019/0093892 | A1 | 3/2019 | Rimmer |
| 2022/0325891 | A1 | 10/2022 | Kediya |

* cited by examiner

GAS TURBINE ENGINE COMBUSTOR WITH OPENINGS

CROSS-REFERENCE TO RELATED APPLICATIONS

This application claims priority to U.S. patent application Ser. No. 18/187,359, filed Mar. 21, 2023, now U.S. Pat. No. 12,007,114, which is hereby incorporated by reference in its entirety.

TECHNICAL FIELD

The present subject matter relates generally to a gas turbine engine combustor with a set of openings, more specifically to a combustor having a set of openings located in a dome wall.

BACKGROUND

Gas turbine engines are driven by a flow of combustion gases passing through the engine to rotate a multitude of turbine blades. A combustor can be provided within the gas turbine engine and is fluidly coupled with a turbine into which the combusted gases flow.

The use of hydrocarbon fuels in the combustor of a gas turbine engine is known. Generally, air and fuel are fed to a combustion chamber, the air and fuel are mixed, and then the fuel mixture is combusted to produce hot gas. The hot gas is then fed to a turbine where it rotates the turbine, cools and expands to produce power. By-products of the hydrocarbon fuel combustion typically include nitrogen oxide and nitrogen dioxide (collectively called NOx), carbon monoxide (CO), unburned hydrocarbon (UHC) (e.g., methane and volatile organic compounds that contribute to the formation of atmospheric ozone), and other oxides, including oxides of sulfur (e.g., $SO_2$ and $SO_3$).

BRIEF DESCRIPTION OF THE DRAWINGS

A full and enabling disclosure, including the best mode thereof, directed to one of ordinary skill in the art, is set forth in the specification, which makes reference to the appended figures in which.

DETAILED DESCRIPTION

Figure 1:
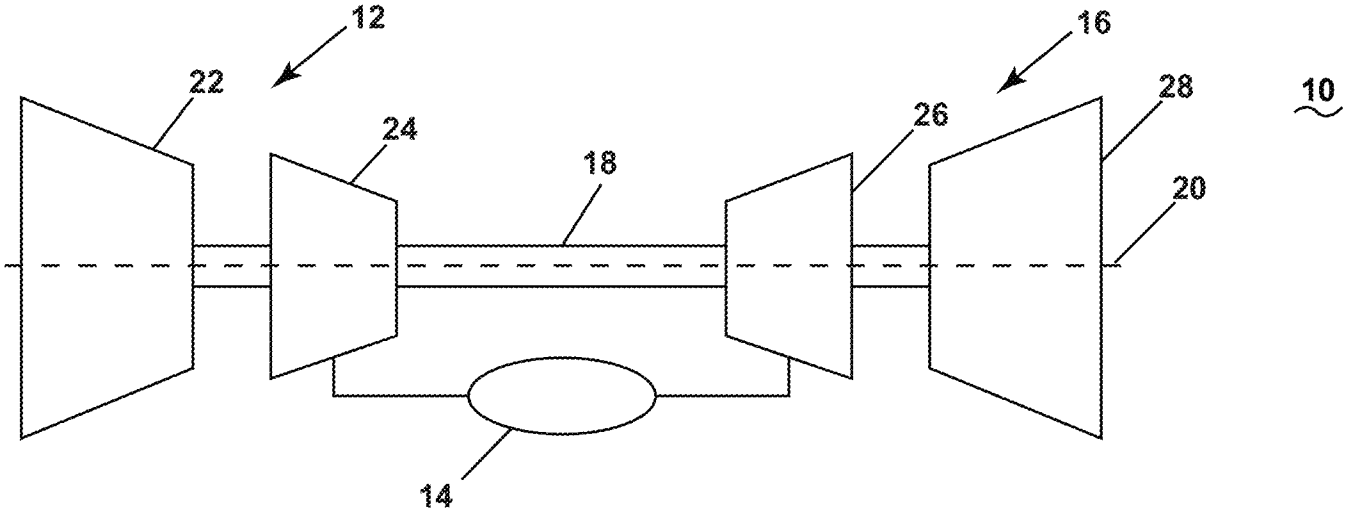
FIG. 1 is a schematic of a gas turbine engine in accordance with aspects described herein.

Aspects of the disclosure herein are directed to combustor architecture located within a gas turbine engine, and more specifically to a dome wall structure configured for use with heightened combustion engine temperatures, such as those utilizing a hydrogen fuel or hydrogen fuel mixes. Higher temperature and hydrogen-based fuels can reduce or eliminate carbon emissions, but generate challenges relating to flame holding or excessive temperatures due to the higher flame speed and burn temperatures. Current combustors may be susceptible to flame holding or excessive temperatures on combustor components when using such high-temperature fuels due. For purposes of illustration, the present disclosure will be described with respect to a turbine engine for an aircraft with a combustor driving the turbine. It will be understood, however, that aspects of the disclosure herein are not so limited, and can have application in other residential or industrial applications.

During combustion, the engine generates high local temperatures. Efficiency and carbon emission needs can be met with fuels that burn hotter than traditional fuels, or that reduce carbon emissions by the use of fuels with higher burn temperatures. Such fuels can include lighter than air fuels, such as hydrogen in the gaseous phase. Utilizing current engines with fuels with higher burn temperatures and burn speeds may result in flame holding on the combustor components.

Reference will now be made in detail to the combustor architecture, and in particular for use with a gas turbine engine, one or more examples of which are illustrated in the accompanying drawings. The detailed description uses numerical and letter designations to refer to features in the drawings. Like or similar designations in the drawings and description have been used to refer to like or similar parts of the disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

The terms "forward" and "aft" refer to relative positions within a turbine engine or vehicle, and refer to the normal operational attitude of the turbine engine or vehicle. For example, with regard to a turbine engine, forward refers to a position closer to an engine inlet and aft refers to a position closer to an engine nozzle or exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluid communication" means that a fluid is capable of making the connection between the areas specified.

The term "flame holding" relates to the condition of continuous combustion of a fuel such that a flame is maintained along or near to a component, and usually a portion of the fuel nozzle assembly as described herein.

Additionally, as used herein, the terms "radial" or "radially" refer to a direction away from a common center. For example, in the overall context of a turbine engine, radial refers to a direction along a ray extending between a center longitudinal axis of the engine and an outer engine circumference.

All directional references (e.g., radial, axial, upper, lower, lateral, vertical, horizontal, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer those two elements are directly connected and in fixed relation to one another. The exemplary drawings are for purposes of illustration only and the dimensions, positions, order and relative sizes reflected in the drawings attached hereto can vary.

The singular forms "a" "an", and "the" include plural references unless the context clearly dictates otherwise. Furthermore, as used herein, the term "set" or a "set" of elements can be any number of elements, including only one.

Approximating language, as used herein throughout the specification and claims, is applied to modify any quantitative representation that could permissibly vary without resulting in a change in the basic function to which it is related. Accordingly, a value modified by a term or terms, such as "about", "approximately", "generally", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

The combustor introduces fuel from a fuel nozzle, which is mixed with air provided by a swirler, and then combusted within the combustor to drive the engine. Increases in efficiency and reduction in emissions have driven the need to use fuel that burns cleaner or at higher temperatures. There is a need to improve durability of the combustor under these operating parameters, such as improved flame control to prevent flame holding on the fuel nozzle and swirler components.

FIG. 1 is a schematic view of an engine as an exemplary gas turbine engine 10. As a non-limiting example, the gas turbine engine 10 can be used within an aircraft. The gas turbine engine 10 can include, at least, a compressor section 12, a combustion section 14, and a turbine section 16. A drive shaft 18 rotationally couples the compressor and turbine sections 12, 16, such that rotation of one affects the rotation of the other, and defines an engine rotational axis 20 for the gas turbine engine 10.

The compressor section 12 can include a low-pressure (LP) compressor 22, and a high-pressure (HP) compressor 24 serially fluidly coupled to one another. The turbine section 16 can include an LP turbine 28, and an HP turbine 26 serially fluidly coupled to one another. The drive shaft 18 can operatively couple the LP compressor 22, the HP compressor 24, the LP turbine 28 and the HP turbine 26 together. Alternatively, the drive shaft 18 can include an LP drive shaft (not illustrated) and an HP drive shaft (not illustrated). The LP drive shaft can couple the LP compressor 22 to the LP turbine 28, and the HP drive shaft can couple the HP compressor 24 to the HP turbine 26. An LP spool can be defined as the combination of the LP compressor 22, the LP turbine 28, and the LP drive shaft such that the rotation of the LP turbine 28 can apply a driving force to the LP drive shaft, which in turn can rotate the LP compressor 22. An HP spool can be defined as the combination of the HP compressor 24, the HP turbine 26, and the HP drive shaft such that the rotation of the HP turbine 26 can apply a driving force to the HP drive shaft which in turn can rotate the HP compressor 24.

The compressor section 12 can include a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a casing which can extend circumferentially about the gas turbine engine 10. It will be appreciated that the representation of the compressor section 12 is merely schematic and that there can be any number of stages. Further, it is contemplated, that there can be any other number of components within the compressor section 12.

Similar to the compressor section 12, the turbine section 16 can include a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section can be mounted to the casing in a circumferential manner. It is noted that there can be any number of blades, vanes and turbine stages as the illustrated turbine section is merely a schematic representation. Further, it is contemplated, that there can be any other number of components within the turbine section 16.

The combustion section 14 can be provided serially between the compressor section 12 and the turbine section 16. The combustion section 14 can be fluidly coupled to at least a portion of the compressor section 12 and the turbine section 16 such that the combustion section 14 at least partially fluidly couples the compressor section 12 to the turbine section 16. As a non-limiting example, the combustion section 14 can be fluidly coupled to the HP compressor 24 at an upstream end of the combustion section 14 and to the HP turbine 26 at a downstream end of the combustion section 14.

During operation of the gas turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited, thereby generating combustion gases. Some work is extracted from these combustion gases by the HP turbine 26, which drives the HP compressor 24. The combustion gases are discharged into the LP turbine 28, which extracts additional work to drive the LP compressor 22, and the exhaust gas is ultimately discharged from the gas turbine engine 10 via an exhaust section (not illustrated) downstream of the turbine section 16. The driving of the LP turbine 28 drives the LP spool to rotate the fan (not illustrated) and the LP compressor 22. The pressurized airflow and the combustion gases can together define a working airflow that flows through the fan, compressor section 12, combustion section 14, and turbine section 16 of the gas turbine engine 10.

Figure 2:
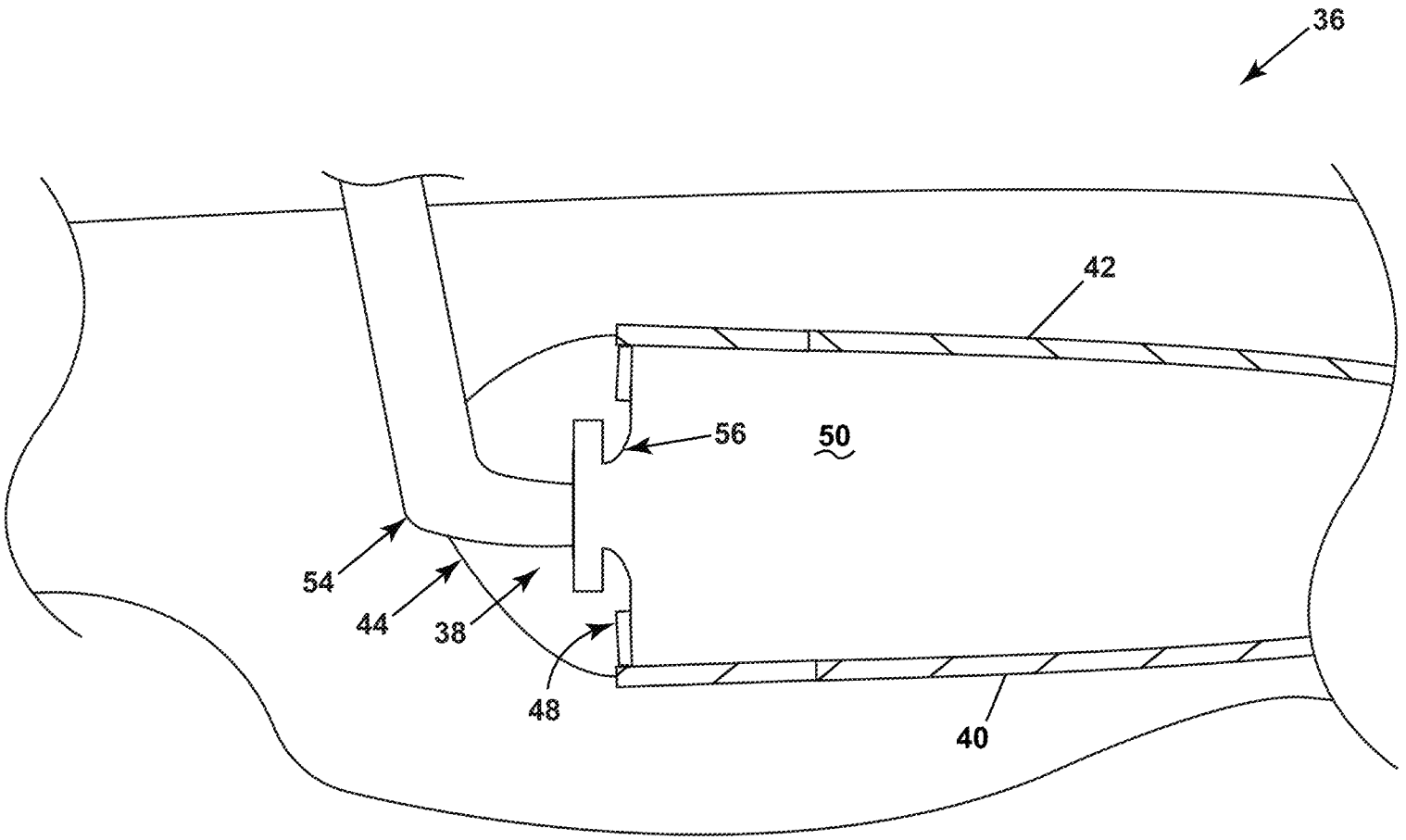
FIG. 2 depicts a cross-sectional view of a combustion section of the gas turbine engine of FIG. 1 in accordance with aspects described herein.

FIG. 2 depicts a cross-section view of a combustor 36 suitable for use in the combustion section 14 of FIG. 1. The combustor 36 can include an annular arrangement of fuel nozzle assemblies 38 for providing fuel to the combustor 36. It should be appreciated that the fuel nozzle assemblies 38 can be organized as in an annular arrangement including multiple fuel injectors. The combustor 36 can have a can, can-annular, or annular arrangement depending on the type of engine in which the combustor 36 is located. The combustor 36 can include an annular inner combustor liner 40 and an annular outer combustor liner 42, a dome assembly 44, and a deflector 48, which collectively define a combustion chamber 50. At least one fuel injector 54 is fluidly coupled to the combustion chamber 50 to supply fuel to the combustor 36 via the fuel nozzle assembly 38.

Figure 3:
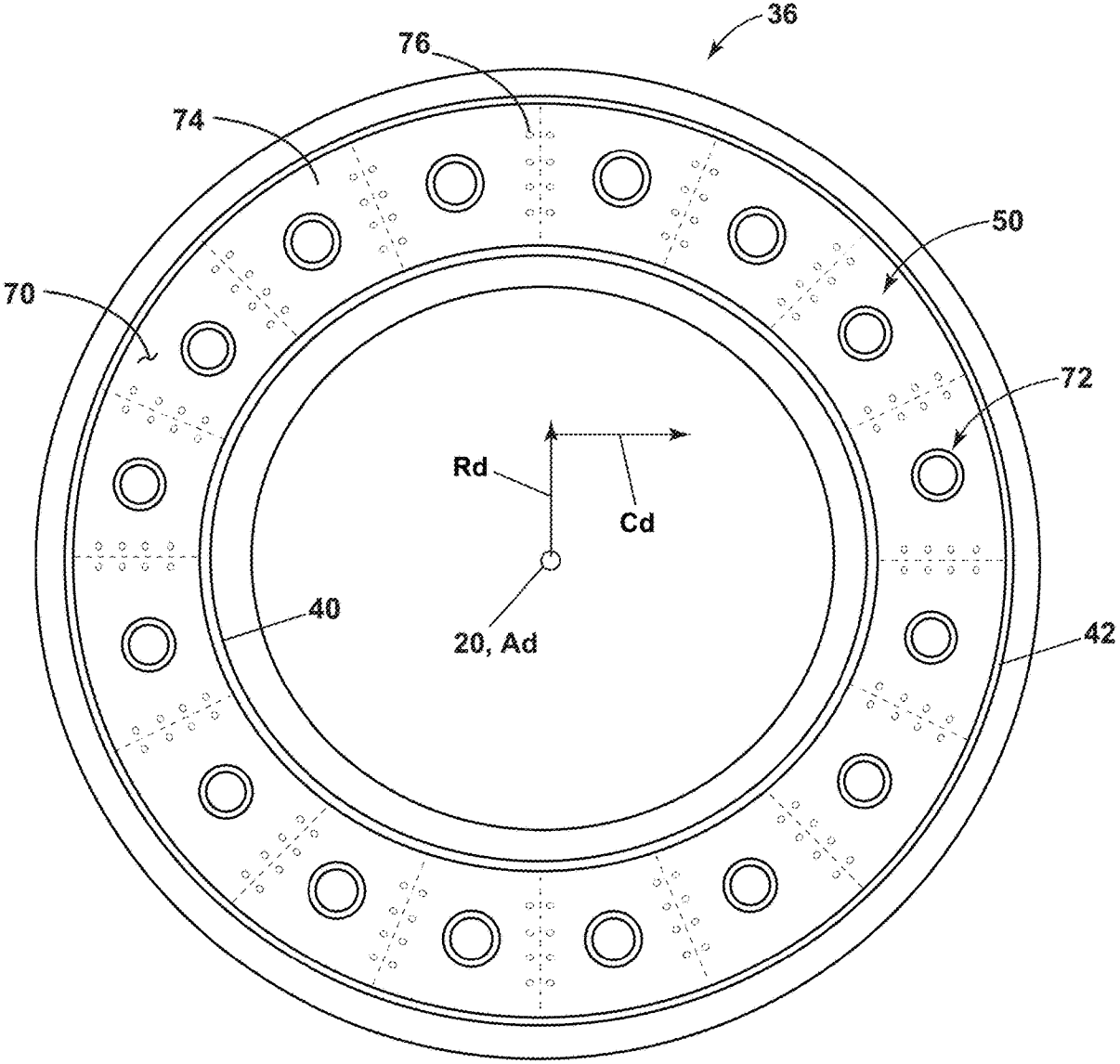
FIG. 3 is a schematic view of the combustion section of the gas turbine engine of FIG. 1, looking in a direction from aft-to-forward, showing a dome wall having a set of fuel nozzles arranged on a set of dome wall segments, in accordance with aspects described herein.

FIG. 3 shows a view of the combustor 36, including an annular arrangement about the engine rotational axis 20, looking in a direction from aft to forward. A dome wall 70 has a set of fuel nozzles 72, which can include the flare cone 56 of FIG. 2, for example. The dome wall 70 can be separated into individual portions or segments 74, collectively defining an annular shape, while a unitary dome wall is contemplated. Such portions or segments 74 can each include only one or more than one fuel nozzles of the set of fuel nozzles 72. Only one fuel nozzle 72 of the set of fuel nozzles 72 is shown in each segment 74, while multiple fuel nozzles 72 in each segment 74 is contemplated. Furthermore, while sixteen fuel nozzles 72 are shown, it should be appreciated that this number is for illustration only, and any suitable number of fuel nozzles 72 is contemplated. A set of openings 76 can be provided in the dome wall 70 permitting a volume of fluid or air to pass through the dome wall 70 and into the combustion chamber 50 through the set of openings 76. While the set of openings 76 are shown as circular, it should be understood that any suitable shape is contemplated, including a cross-sectional shape, such as at the inlet or outlet for the openings 76, which can include circular, oval, racetrack, elliptical, squared, linear, curved, curvilinear, or combinations thereof in non-limiting examples.

For sake of reference, a set of relative reference directions, along with a coordinate system can be applied to the combustor 36. An axial direction (Ad) can be defined along the engine rotational axis 20, can extend from forward to aft and is shown extending into and out of the page as shown in FIG. 3. A radial direction (Rd) extends perpendicular to the axial direction (Ad). A circumferential direction (Cd) can be defined as a ray extending perpendicular to the radial direction (Rd), and can be defined along the circumference of the gas turbine engine 10 relative to the engine rotational axis 20.

Figure 4:
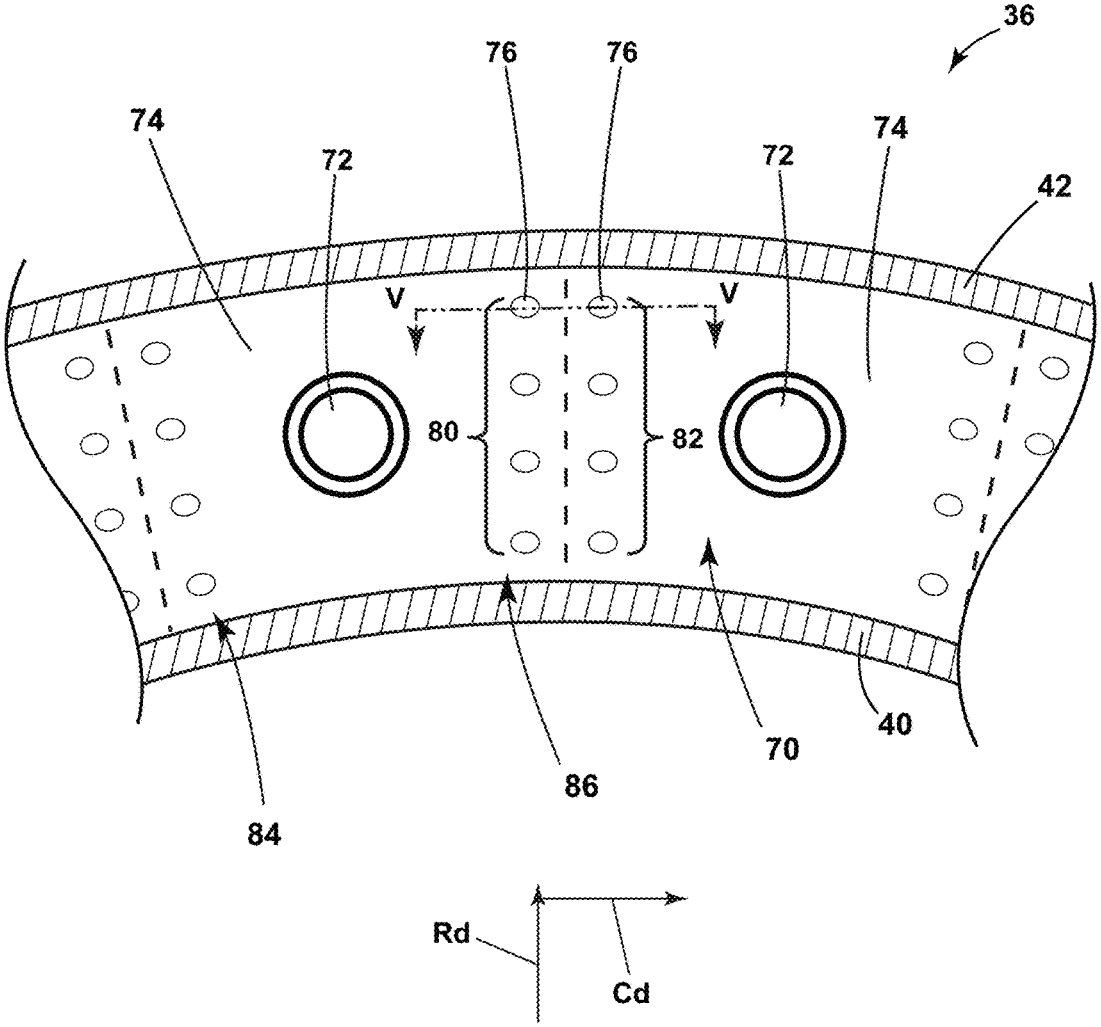
FIG. 4 is an enlarged view of two segments of the dome wall of FIG. 3, including openings provided in the dome wall and segments thereof, in accordance with aspects described herein.

FIG. 4 shows an enlarged view of two adjacent segments 74 of FIG. 3. The set of openings 76 can be grouped as a first set 80 arranged at a first circumferential side 84 of the segment 74, and a second set 82 arranged at a second circumferential side 86 of the segment 74. Each of the openings of the set of openings 76 in each of the first set 80 and the second set 82 can be aligned along the radial direction (Rd) and separated among adjacent segments 74. Furthermore, the openings 76 among the first set 80 and the second set 82 can be aligned in the circumferential direction (Cd). As shown, each of the first set 80 and the second set 82 can include a set of four openings 76 where each opening of the first set 80 is aligned in the circumferential direction (Cd) with a complementary opening 76 of the second set 82. While four openings 76 are shown in each of the first and second sets 80, 82, it should be appreciated that any number of openings is contemplated.

Figure 5:
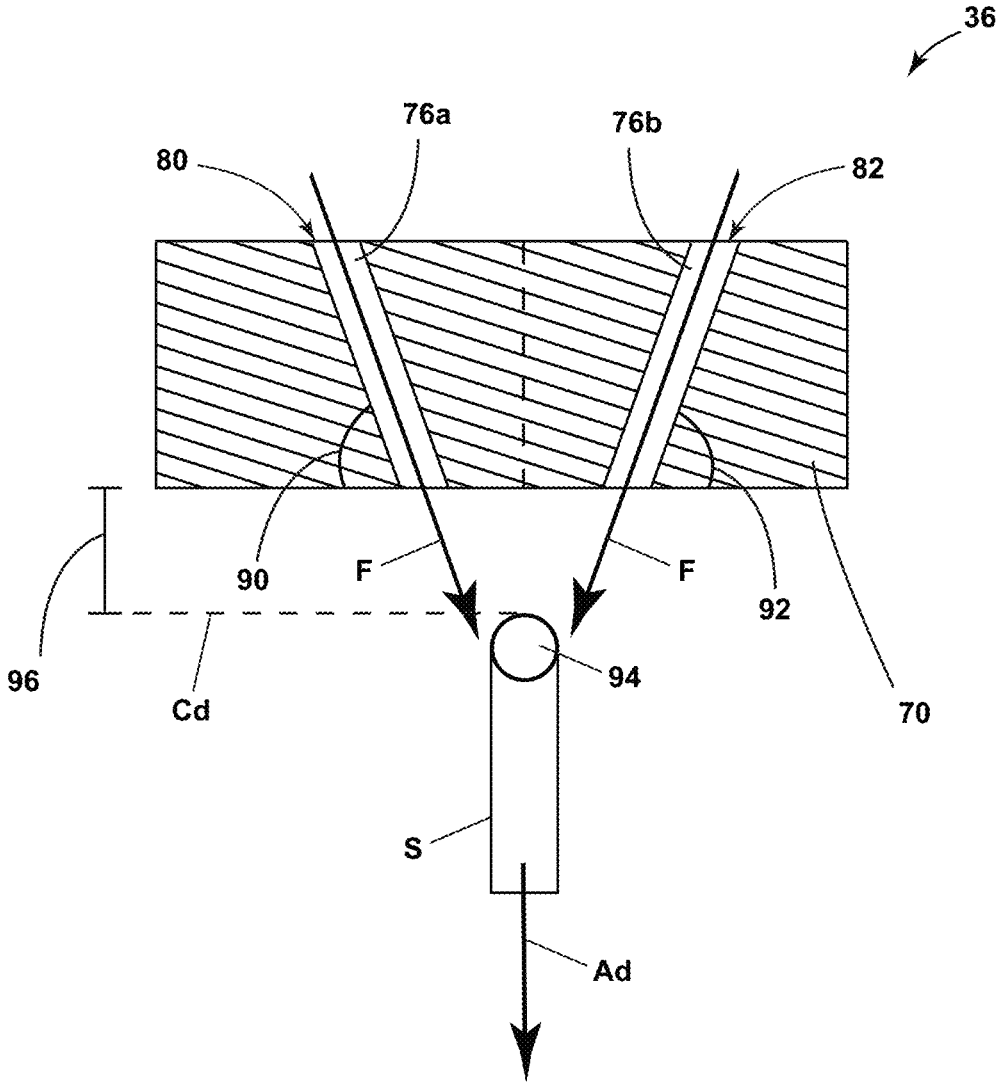
FIG. 5 is a cross-sectional view of two openings of FIG. 4 taken along line V-V of FIG. 4, illustrating the angled orientation of the openings and forming a sheet of air, in accordance with aspects described herein.

FIG. 5 shows a section view of a portion of the dome wall 70 taken along line V-V of FIG. 4, showing one opening 76*a* from the first set 80 and one opening 76*b* from the second set 82. The openings 76*a*, 76*b* can be arranged at an angle relative to the circumferential direction (Cd) (FIG. 4), or relative to an axis defined along the dome wall 70. The opening 76*a*, as well as all openings from the first set 80 can be arranged at a first angle 90, and the opening 76*b*, as well as all openings from the second set 82, can be arranged at a second angle 92. The first and second angle 90, 92 can be between 15-degrees to 135-degrees, in one non-limiting example, while a range of 1-degree to 179-degrees is contemplated. Furthermore, the first angle 90 and the second angle 92 can be the same, while it is further contemplated that the first angle 90 and the second angle 92 can be supplementary, totaling 180-degrees when measured from a common side or dimension of the openings 76*a*, 76*b*. A same angle 90, 92 or a different angle can be utilized to form different control flow structures within the combustion chamber 50, which are used for flame control or flame shaping.

During operation, a flow of air F can be provided through the openings 76*a*, 76*b*, where the flow of air F can define a flow path streamline through each opening 76*a*, 76*b*. Due to the first and second angles 90, 92, the flow of air F exhausting from the openings 76*a*, 76*b* can intersect, or impinge upon one another at an intersection point 94, forming a curtain of air or sheet of air S. The intersection point 94 defines a distance 96 from the dome wall 70, and can be measured in the axial direction (Ad), or perpendicular to the dome wall 70. The distance 96 can be a function of the openings 76*a*, 76*b*, for example, where the distance 96 can be defined as less than ten times the length of a maximum cross-sectional distance or length for the openings 76*a*, 76*b*.

The sheet of air S can be defined based upon a common arrangement of the openings 76*a*, 76*b*, where such a common arrangement can be a projection of the openings 76*a*, 76*b* on a common plane. Such a common plane can be arranged in the radial and axial directions, for example, while any suitable three-dimensional arrangement or position for the common plane is contemplated. More specifically, the first angle 90 and the second angle 92 can be specifically determined, in order to determine a directionality, thickness, and force of the sheet of air S. A complementary arrangement can be one where the first angle 90 and the second angle 92 are the same, creating the sheet of air S that moves generally in the axial direction Ad, or axially or radially aligned relative to the segments 74, or the junction therebetween, in non-limiting examples.

Returning to FIG. 4, each opening 76 in each of the first set 80 and the second set 82 can be similarly angled, such as that described in relation to FIG. 5 above. Each opening 76 in the first set 80 can include the same angle as the first angle 90 and each opening 76 of the second set 82 can include the same angle as the second angle 92. In this way, the sheet of air S can extend in the radial direction (Rd), with a radial length for the sheet of air S being defined by the number of openings 76 utilized, as well as the sizing or geometry thereof.

Utilizing the openings 76, or openings 76 arranged as the sets 80, 82, can provide for forming one or more sheets of air S that extend into the combustion chamber 50. The arrangement, angled orientation, and number of openings 76 can be used to determinatively create a system of multiple sheets of air S extending into the combustion chamber 50. Using these sheets of air S, one can effectively shape a flame produced by the combustor 36 and extending into the combustion chamber 50 (FIG. 2). Controlling the shape of the flame can decrease flame scrubbing on the inner and outer combustor liners 40, 42 (FIG. 2) and the dome wall 70, increasing the temperature durability of the combustor 36. Increasing temperature durability permits the use of higher-temperature fuels, such as hydrogen or hydrogen-based fuels, which may otherwise be too hot for the combustor 36. Controlling the flame shape and geometry can increase engine temperature tolerabilities, which can increase overall engine efficiency with more efficient fuels, as well as reducing overall engine emissions through the use of more efficient fuels, like hydrogen fuels, while current or traditional engine combustors would be unable to operate under the harsh conditions or temperatures associated with high-temperature or hydrogen fuels.

Figure 6:
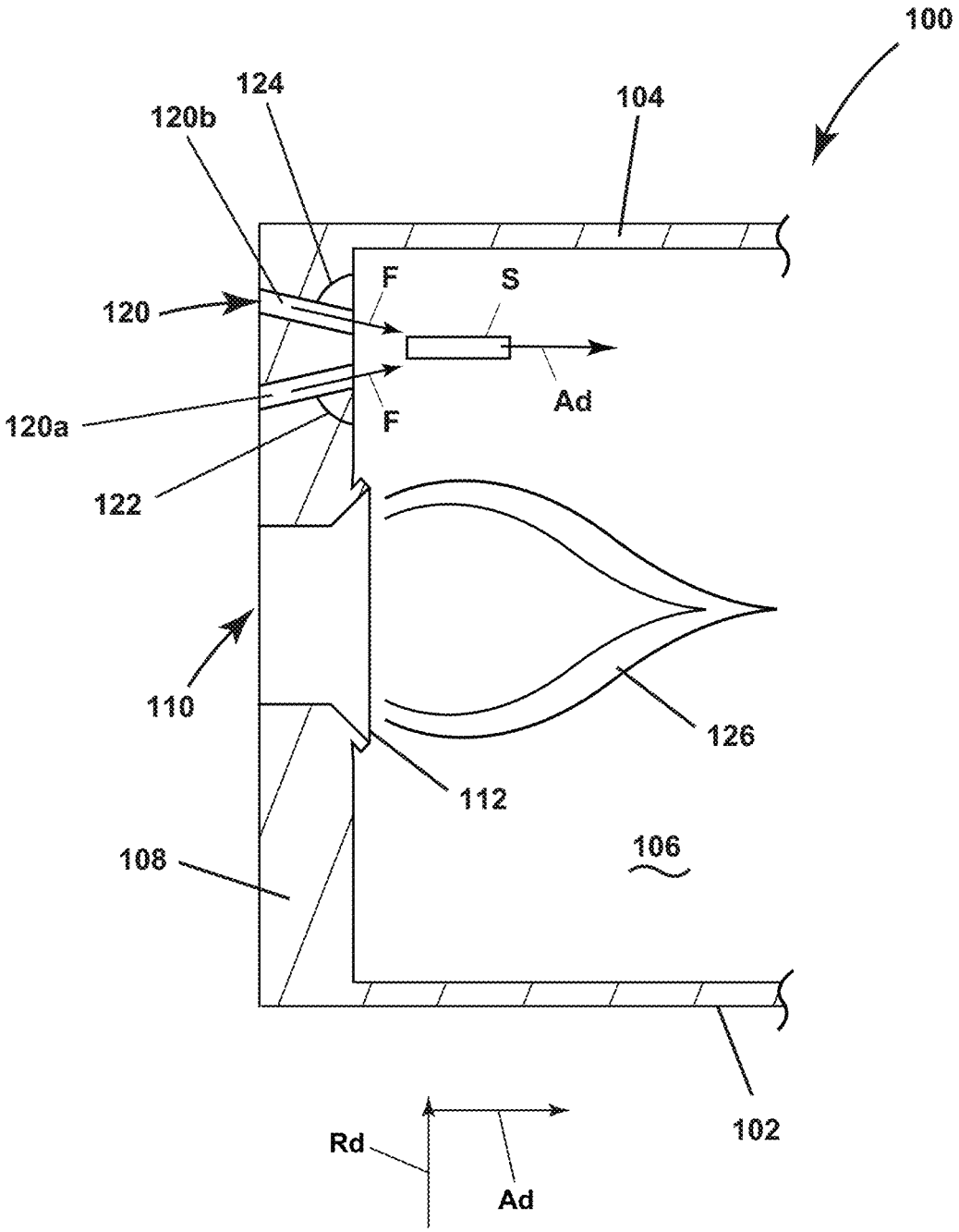
FIG. 6 is a cross-sectional view of an alternative combustion section for use in the gas turbine engine of FIG. 1, illustrating another angled orientation for alternative openings forming a sheet of air, in accordance with aspects described herein.

FIG. 6 shows a radial, sectional view of another combustor assembly 100, including an inner combustor liner 102 and an outer combustor liner 104 defining a combustion chamber 106 therebetween. A dome wall 108 supports a fuel nozzle assembly 110 having a nozzle 112 opening into the combustion chamber 106 to deliver a fuel to the combustion chamber 106. A set of openings 120 can be provided in the dome wall 108, exhausting into the combustion chamber 106, and can include a radially inner opening 120*a* and a radially outer opening 120*b*. Additionally, it is contemplated that the set of openings 120 are arranged as sets of openings extending in the circumferential direction (Cd), but are not visible in the section view as shown.

The radially inner opening 120*a* can be arranged at a first angle 122 and the radially outer opening 120*b* can be arranged at a second angle 124. The first and second angles 122, 124 can be defined relative to the radial direction (Rd), or relative to an axis defined along the dome wall 108, and can be between 15-degrees and 135-degrees, for example. Further, the first and second angles 122, 124 can be defined such that the radially inner opening 120*a* and the radially outer opening 120*b* are angled toward one another, such that a flow of air F passing through each of the radially inner and radially outer openings 120*a*, 120*b* intersects each other or impinges on one another to define a sheet of air S, collectively formed from the flow of air F from the radially inner and radially outer openings 120*a*, 120*b*. The sheet of air S can be formed generally as a plane extending in the radial and axial directions, while a slight variation from a planar sheet of air can occur due to interaction with the harsh conditions in the combustor 36.

Utilizing the radially inner and radially outer openings 120*a*, 120*b* can provide for forming one or more sheets of air S that extend into the combustion chamber 106. The arrangement, angled orientation, opening size, and number of openings in the set of openings 120 can be used to determinatively create one or more sheets of air S that extends in the axial and circumferential directions. Using these sheets of air S, one can effectively shape a flame 126 produced by the combustor assembly 100 and extending into the combustion chamber 106. More specifically, the position of the sheet of air S can extend between the flame 126 and another portion of the combustor assembly 100, such as the outer combustor liner 104 as shown, in order to shield the combustor liner 104 from the flame 126. Furthermore, the sheet of air S can be positioned adjacent to, or about at least a portion of the flame 126, thereby shielding or otherwise preventing movement of a portion of the flame 126 across or over the sheet of air S. Controlling the shape of the flame 126 can decrease flame scrubbing on the inner and outer combustor liners 102, 104 and the dome wall 108, increasing the temperature durability of the combustor assembly 100. Increasing temperature durability permits the use of higher-temperature fuels, such as hydrogen or hydrogen-based fuels, which may otherwise be too hot for the combustor assembly 100. Controlling the flame shape and geometry can increase engine temperature tolerabilities, which can increase overall engine efficiency with more efficient fuels, as well as reducing overall engine emissions through the use of more efficient fuels, like hydrogen fuels, while current or traditional engine combustors would be unable to operate under the harsh conditions or temperatures associated with high-temperature or hydrogen fuels.

It should be appreciated that the orientation or directionality of a sheet of air S can be determined by the arrangement or orientation, size, and flow rates through each set of the openings that provide the flow of air F to form the sheet of air S, such as that detailed in FIG. 5. More specifically, at least two openings are required to generate a flow of air F that can combine to form the sheet of air S, and the angle or orientation of those at least two openings can define the geometry of the resulting sheet of air. Therefore, it is contemplated that discrete sheets of air S, and positioning thereof, can be utilized to shape the flame 126.

Figure 7:
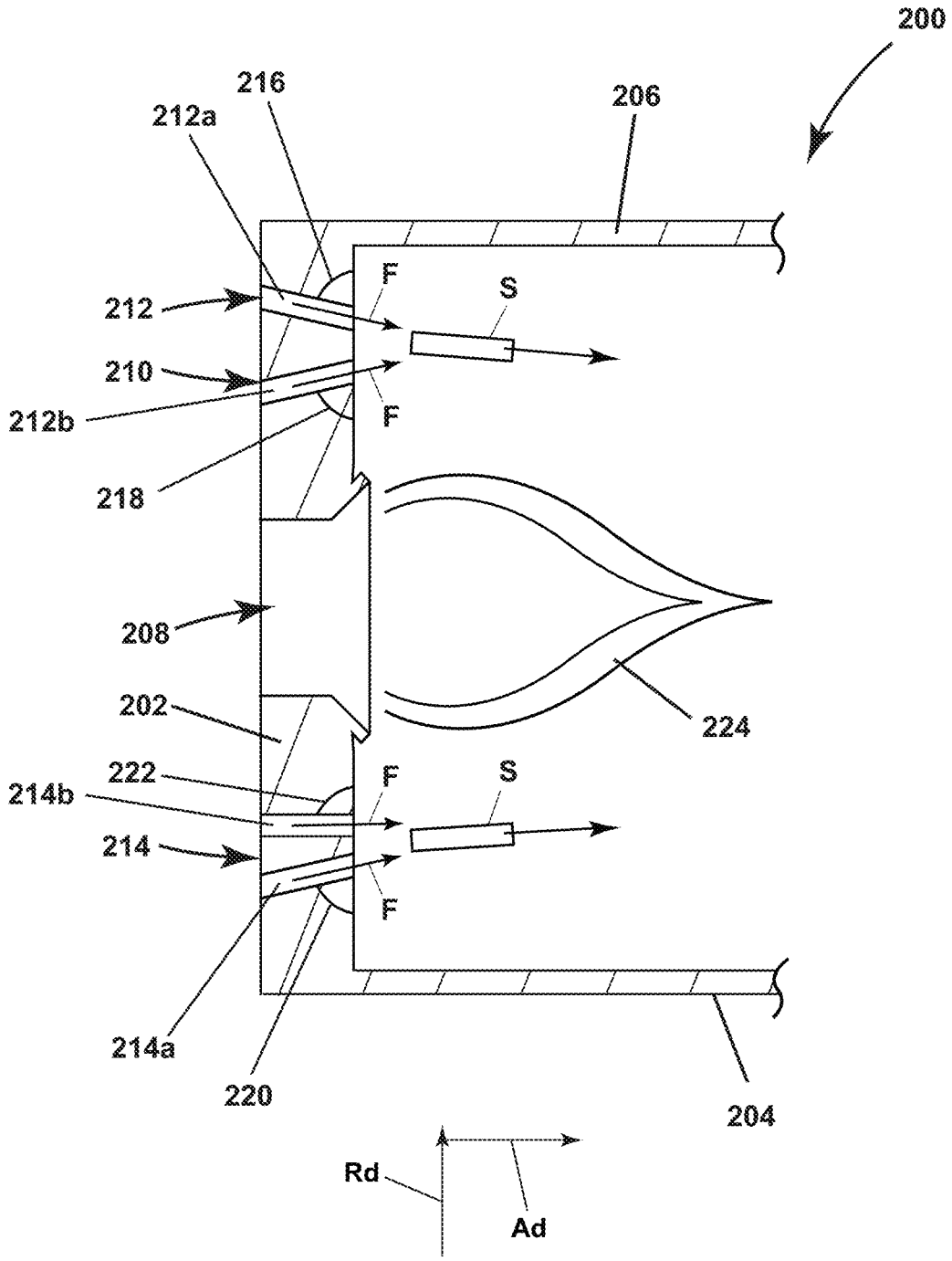
FIG. 7 is a cross-sectional view of another alternative combustion section for use in the gas turbine engine of FIG. 1, where the angled orientation among openings forming a sheet of air differs among the openings being determinative in forming a sheet of air, in accordance with aspects described herein.

More specifically, now referring to FIG. 7, another exemplary combustor assembly 200 can include a dome wall 202 having an inner combustor liner 204 and an outer combustor liner 206, with a fuel nozzle 208 provided on the dome wall 202. A set of openings 210 can be provided in the dome wall 202, providing a flow of air F to the combustor assembly 200 through the dome wall 202. The sets of openings 210 can include a first pair of openings 212 and a second pair of openings 214. While the first pair of openings 212 is positioned radially exterior of the fuel nozzle 208 and the second pair of openings 214 are positioned radially interior of the fuel nozzle 208, it should be appreciated that such positioning is exemplary only, and that any positioning relative to the fuel nozzle 208 or elsewhere on the dome wall 202 is contemplated.

The first pair of openings 212 can be arranged at a first angle 216 and a second angle 218 relative to the radial direction (Rd), or relative to an axis defined along the dome wall 202. The first angle 216 can be the same as the second angle 218, providing a flow of air F that has a similar directionality among the first pair of openings 212 oriented toward one another to form a sheet of air S. A flow rate for a volume of the flow of air F through the first pair of openings 212 can be different, such that the volume of air passing through the one opening is different than the volume of air passing through the other opening. The different flow rates can be defined by any suitable means, such as through different cross-sectional areas for the first pair of openings 212, or a flow limiting structure or feature provided in one opening of the first pair of openings 212 in non-limiting examples. Utilizing a different flow rate can affect the positioning or orientation of the sheet of air S formed from the first pair of openings 212. For example, if the flow rate for a radially outer opening 212*a* is greater than that of a radially inner opening 212*b*, then the resulting sheet of air S will have an orientation that more-closely matches the directionality of the greater flow rate, being angled radially inward, as is appreciable in FIG. 7.

The second pair of openings 214 can be arranged at a third angle 220 and a fourth angle 222, where the third angle 220 is different than the fourth angle 222, while having the same flow rate for a flow of air F passing through the second pair of openings 214. The different angles for the third and fourth angle 220, 222 can affect the positioning or orientation of the sheet of air S formed from the first pair of openings 212. For example, if the third angle 220 for a radially inner opening 214*a* is less than the fourth angle 222 of a radially outer opening 214*b*, then the resulting sheet of air S will have an orientation that accounts for the directionality defined by of the third and fourth angles 220, 222, as is appreciable in FIG. 7. It is contemplated that the lesser angle can be between 0-degrees and 179-degrees, relative to the radial direction (Rd), while the greater angle can be between 1-degree and 180-degrees, while remaining greater than the lesser angle.

It should be understood that utilizing differing angles or differing flow rates, or both, for two openings forming a sheet of air can orient or otherwise arrange the sheet of air at an angular offset from the radial, axial, or circumferential directions. Utilizing such an orientation or arrangement can provide for increased flame control, by utilizing a deterministic approach to position multiple sheets of air about a flame 224, thereby increasing or improving flame control. Improving flame control can permit the use of higher-temperature fuels, such as hydrogen fuels, where a typical combustor would otherwise be incapable of operating under the conditions generated by such fuels without having improved flame control.

Figure 8:
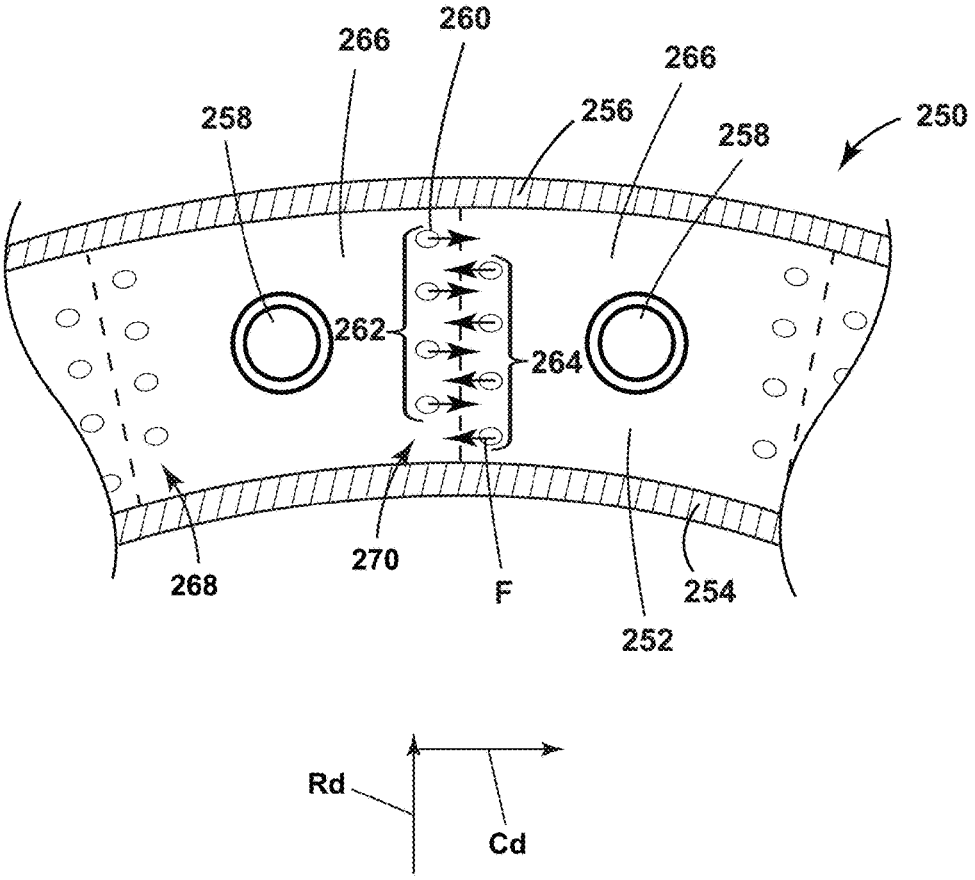
FIG. 8 is an enlarged view of alternative two segments of a dome wall, including openings having a circumferentially offset arrangement, in accordance with aspects described herein.

Referring to FIG. 8, another exemplary combustor 250 can include a dome wall 252 having an inner combustor liner 254 and an outer combustor liner 256, with a set of fuel nozzles 258 provided on the dome wall 252 arranged into a set of segments 266. A set of openings 260 can be provided in the dome wall 252, providing a flow of air F to the combustor 250 through the dome wall 252. The sets of openings 260 can be arranged into a first set 262 and a second set 264, with each set being aligned in the radial direction (Rd), and can be delineated between adjacent segments 266 of the dome wall 252, for example. The first set 262 can be circumferentially offset or unaligned with the second set 264, while a radial offset or combination radial-circumferential offset is contemplated. That is, the openings 260 in the first set 262 are circumferentially offset from the openings 260 in the second set 264, relative to the circumferential direction (Cd). In another example, it is contemplated that the flow arrangement among the first set 262 and the second set 264 is such that the sets do not impinge on one another, but form a set of interlaced flow streamlines to collectively form a sheet of air, providing a relatively greater air flow which can provide a greater amount of protection against the combusted fuel, as well as a broader area of coverage. It should be appreciated that while only two sets 262, 264 are shown, that any number of sets is contemplated, and can have any suitable organization or positioning for each set.

In operation, a flow of air F provided from the first set 262 can interact with and impinge upon a flow of air F provided from the second set 262. Utilizing an offset arrangement among the first and second sets 262, 264 provides for creating a wider area for a resultant sheet of air. Furthermore, the offset arrangement can result in a greater overall turbulence and distribution among the set of openings 260, which can provide for greater resistance to deformation or movement resulting from a flame emitted from the set of fuel nozzles 258. The resulting sheet of air can extend in a plane defined along the axial and radial directions.

It is further contemplated that the set of openings 260 from the first set 262 can partially overlap the second set 264, while still remaining unaligned. Further yet, it is contemplated that some openings are aligned, while some openings are unaligned. In further alternative examples, it is contemplated that the radial offset can be consistent among all segments 266. More specifically, the openings 260 on a first circumferential side 268 of each segment 266 can be arranged radially exterior of the openings on a second circumferential side 270 of each segment, thereby defining a consistent circumferential offset among adjacent segments 266. That is, each opening 260 of the first set 262 is arranged radially exterior of a corresponding opening 260 of the second set 264. Alternatively, one segment 266 could include openings on both the first side and the second side that are radially exterior of openings on the first side and the second side of an adjacent segment 266, and the full set of segments 266 could be arranged in an alternating manner. In yet another example, it is contemplated that each segment includes openings that are arranged independent of adjacent segments.

Figure 9:
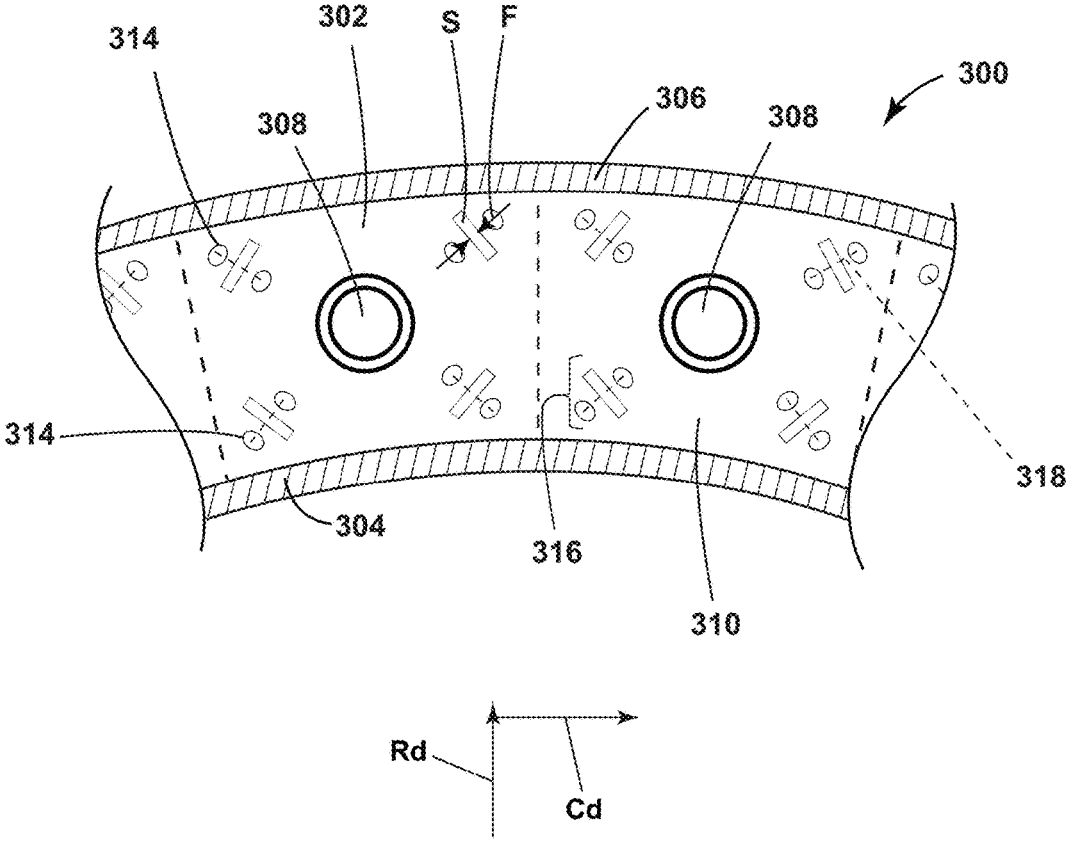
FIG. 9 is an enlarged view of alternative two segments of a dome wall, including openings having a discrete arrangement to form discrete sheets of air, in accordance with aspects described herein.

Referring to FIG. 9, another exemplary combustor 300 can include a dome wall 302 having an inner combustor liner 304 and an outer combustor liner 306, with a set of fuel nozzles 308 provided on the dome wall 302. The dome wall 302 can be separated into a set of segments 310, with each segment including one fuel nozzle 308 and a set of openings 314 providing a flow of air to the combustor 300 through the dome wall 302.

The set of openings 314 can be arranged into pairs of openings 316, shown as four pairs of openings 316. Each pair of openings 316 includes two openings 314 that can be angled or otherwise oriented toward one another, such that the flow of air F passing through the openings 314 intersects or impinges into one another to form a sheet of air S. Each pair of openings 316 can collectively define an opening axis 318, defined between a center of each opening 314 in the pair of openings 316. The pair of openings 316 are angled toward one another such that the flow of air F provided through the pair of openings 316 defines a sheet of air S that is arranged perpendicular to the opening axis 318.

It should be appreciated that utilizing the four pairs of openings 316 in each segment 310 can be used to shape a flame generated from the fuel nozzle 308, as well as contain the flame. Such containment can include providing the sheet of air S between a portion of the flame and a portion of one or more of the inner and outer combustor liners 304, 306. In this way, it should be appreciated that specific shapes for the flame can be discretely shielded by utilizing discrete pairs of openings 316 to form discrete sheets of air S.

Figure 10:
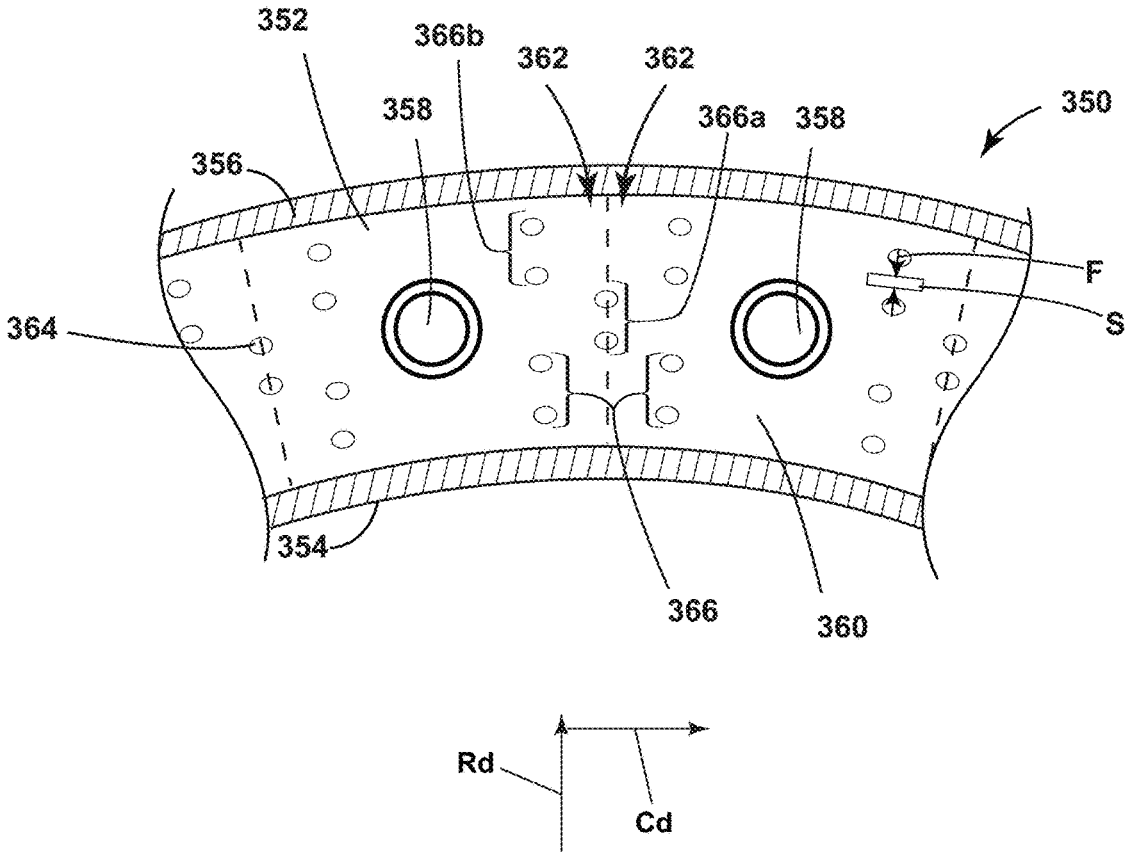
FIG. 10 is an enlarged view of another alternative two segments of a dome wall, including openings having another discrete arrangement to form discrete sheets of air, in accordance with aspects described herein.

Referring to FIG. 10, another exemplary combustor 350 can include a dome wall 352 having an inner combustor liner 354 and an outer combustor liner 356, with a set of fuel nozzles 358 provided on the dome wall 352. The dome wall 352 can be separated into a set of segments 360, with each segment including one fuel nozzle 358 and a set of openings 364 includes multiple openings 366, which can be arranged into pairs, with the openings 366 providing a flow of air F to the combustor 350 through the dome wall 352.

A pair of openings 366*a* can be provided in the dome wall 352, with each opening 366 in the pair of openings 366*a* being angled toward the other opening 366 in a common pair of openings 366*a* to define a sheet of air S. In the example shown, some pairs of openings 366*a* can be positioned between, yet circumferentially aligned with the fuel nozzles 358. Such pairs of openings 366*a* can extend among adjacent segments 360, being defined at least partially within adjacent segments 360. Other pairs of openings 366*b* can be positioned at corners 362 of the dome wall 352, where corners 362 can define an area of the dome wall 352 that is in a corner of the segment 360, or in an area that does not radially or circumferentially overlap with one of the fuel nozzles 358.

It should be appreciated that each opening 366 for each pair of openings 366*a*, 366*b* can be angled toward one another, such a flow of air F from each opening 366 of the pairs of openings 366*a*, 366*b* can intersect, forming a sheet of air S. While only one pair of openings 366*a*, 366*b* is shown having the flow of air F forming the sheet of air S, it should be understood that each arranged pair of openings 366*a*, 366*b* can form a similar sheet of air S when the flow of air F is provided through each opening 366 of the pairs of openings 366*a*, 366*b*.

Figure 11:
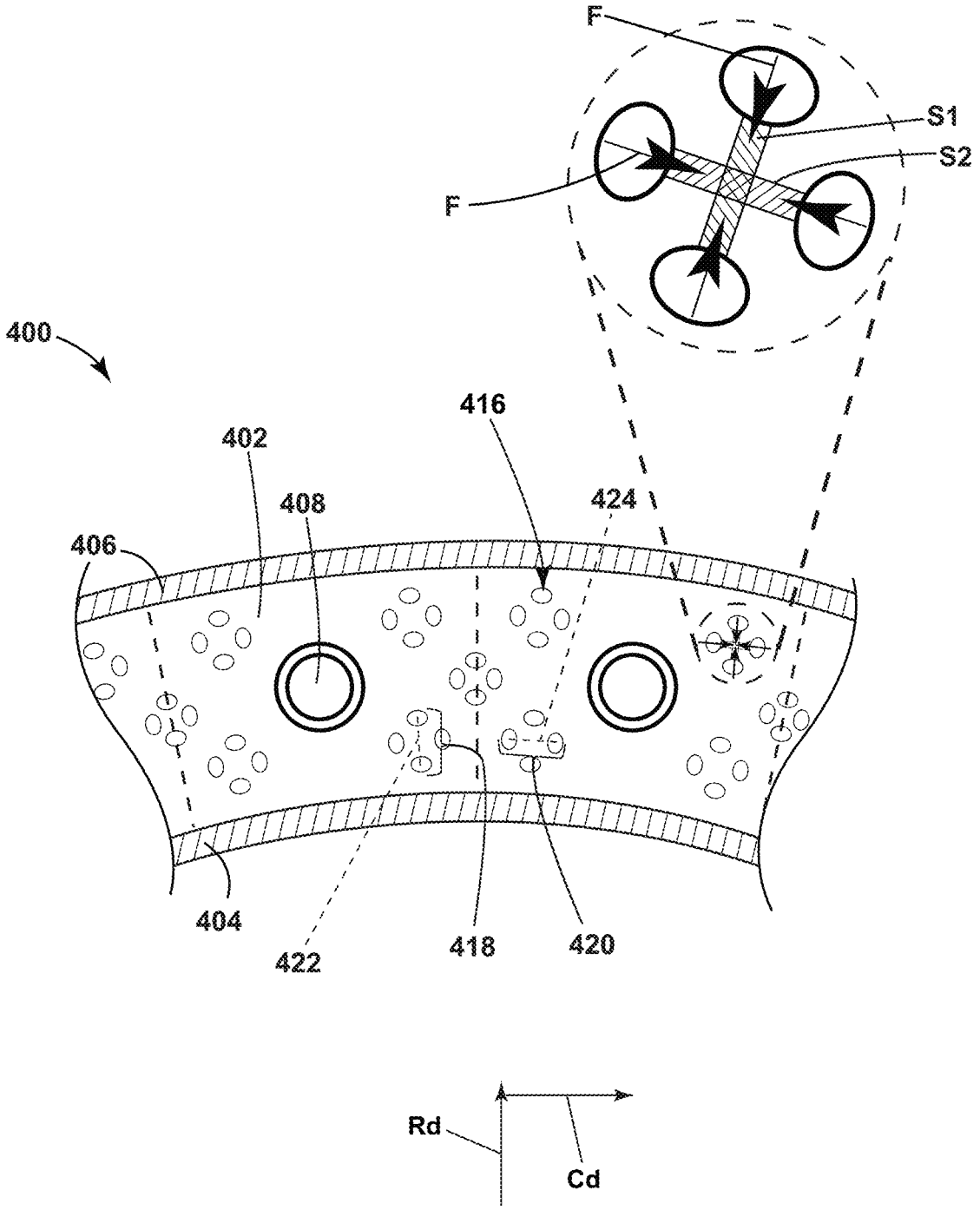
FIG. 11 is an enlarged view of alternative two segments of a dome wall, including openings arranged as two pairs to form two discrete sheets of air having different orientation, in accordance with aspects described herein.

Referring to FIG. 11, another exemplary combustor 400 can be substantially similar to that of FIG. 10, with numerals for similar elements being increased by a value of fifty, and the discussion of FIG. 11 will be limited to the differences among the two, but should not be interpreted as limiting on the embodiment of FIG. 11. More specifically, each pair of openings 366*a*, 366*b* of FIG. 10 is formed as two pairs of openings 416 in FIG. 11, with the positioning of the two pairs of openings 416 correlating to the positioning of one of the pairs of openings 366*a*, 366*b* of FIG. 10. The combustor 400 can include a dome wall 402 having an inner combustor liner 404 and an outer combustor liner 406, with a set of fuel nozzles 408 provided on the dome wall 402.

Each two pairs of openings 416 includes a radial pair 418 and a circumferential pair 420. The radial pair 418 can be radially aligned, and can define a first opening axis 422 defined between the center of each opening defining the radial pair 418. Similarly, the circumferential pair 420 can be circumferentially aligned, and can define a second opening axis 424, arranged perpendicular to the first opening axis 422. It should be appreciated that the first and second opening axes 422, 424 need not be arranged perpendicularly, and that an offset arrangement can be defined by an offset positioning of the openings defining the first and second opening axes 422, 424.

Regardless of individual orientation, each pair of the radial pair and the circumferential pair 418, 420 can define a sheet of air S formed by the intersection of a flow of air F from each opening in each of the two pairs of openings 416 of the radial pair and the circumferential pair 418, 420. As such, the two pairs of openings 416 can create a first sheet of air S1 and a second sheet of air S2 (indicated in FIG. 11 with opposing section lines to aid identification). Utilizing two pairs of openings 416 as the radial pair and the circumferential pair 418, 420 can define pairs of sheets of air S, where each sheet is arranged perpendicular to or otherwise angularly offset from the other sheet of air S. Utilizing two pairs of openings 416 provides for improved directionality for the flow of air F formed as the sheets of air S1, S2. The sheets of air S1, S2 are offset from each other in a space within the combustor 400, defined by sizing, arrangement of the openings or sets thereof. Sheets of air S1, S2 may not intersect with one another. More specifically, utilizing two pairs of openings that provide for two sheets of air S which share at least one common directional component improves directionality of the flow of air F, as well as reducing its susceptibility to variation on intended flow pattern caused by the combusted flame produced by a fuel nozzle 408, or resultant of other operational forces within the combustor 400.

Figure 12:
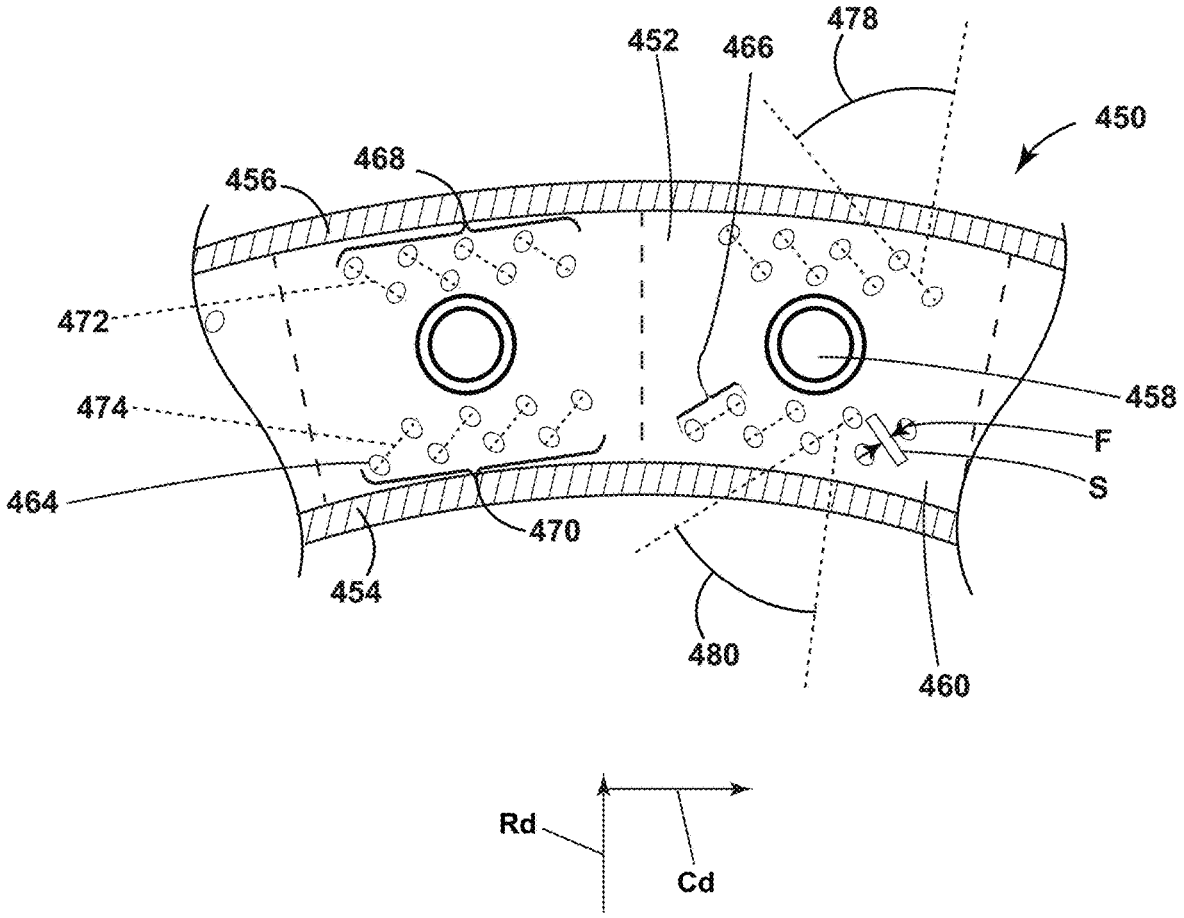
FIG. 12 is an enlarged view of alternative two segments of a dome wall, including openings having an angled arrangement, in accordance with aspects described herein.

Referring to FIG. 12, another exemplary combustor 450 can include a dome wall 452 having an inner combustor liner 454 and an outer combustor liner 456, with a set of fuel nozzles 458 provided on the dome wall 452. The dome wall 452 can be separated into a set of segments 460, with each segment including one fuel nozzle 458 and a set of openings 464 providing a flow of air F to the combustor 450 through the dome wall 452.

The set of openings 464 are arranged into pairs of openings 466, and can be further arranged into a radially outer set 468 and a radially inner set 470, with the radially outer set 468 positioned radially exterior of the fuel nozzle 458, and the radially inner set 470 positioned radially interior of the fuel nozzle 458. Each pair of openings 466 within the radially outer set 468 and the radially inner set 470 can be similarly arranged, such as sharing a similar angular arrangement. More specifically, a first opening axis 472 defined by each pair of openings 466 in the radially outer set 468 can all be arranged at a first common angle 478, relative to the radial direction (Rd). In this way, each pair of openings 466 can define a sheet of air S that has a common arrangement. Similarly, a second opening axis 474, defined by each pair of openings 466 the radially inner set 470, can all be arranged at a second common angle 480, which can be different than the angular arrangement defined by the first common angle 478 In alternative examples, it is contemplated that first common angle 478 can be the same as the second common angle 480.

It should be appreciated that a flame generated by the fuel nozzle 458 can swirl within the combustion chamber, or can have a helical component. Providing pairs of openings 466 that are arranged at a common angle can be arranged complementary to the helical component of the flame locally, which can improve flame control relative to a local flame shape. Further still, sets of pairs of openings 466 can provide multiple layers of sheets of air S, which increases overall durability for the sheets of air S against distortion caused by the flame or engine operational forces. Such increased durability can provide for improved shielding or increased lifetime for the combustor and related components, such as the combustor liners that would be less susceptible to cycle fatigue created by the flame. Furthermore, such increased durability can permit the use of higher-temperature fuels, such as hydrogen fuels, which can increase overall engine efficiency while reducing overall emissions.

Figure 13:
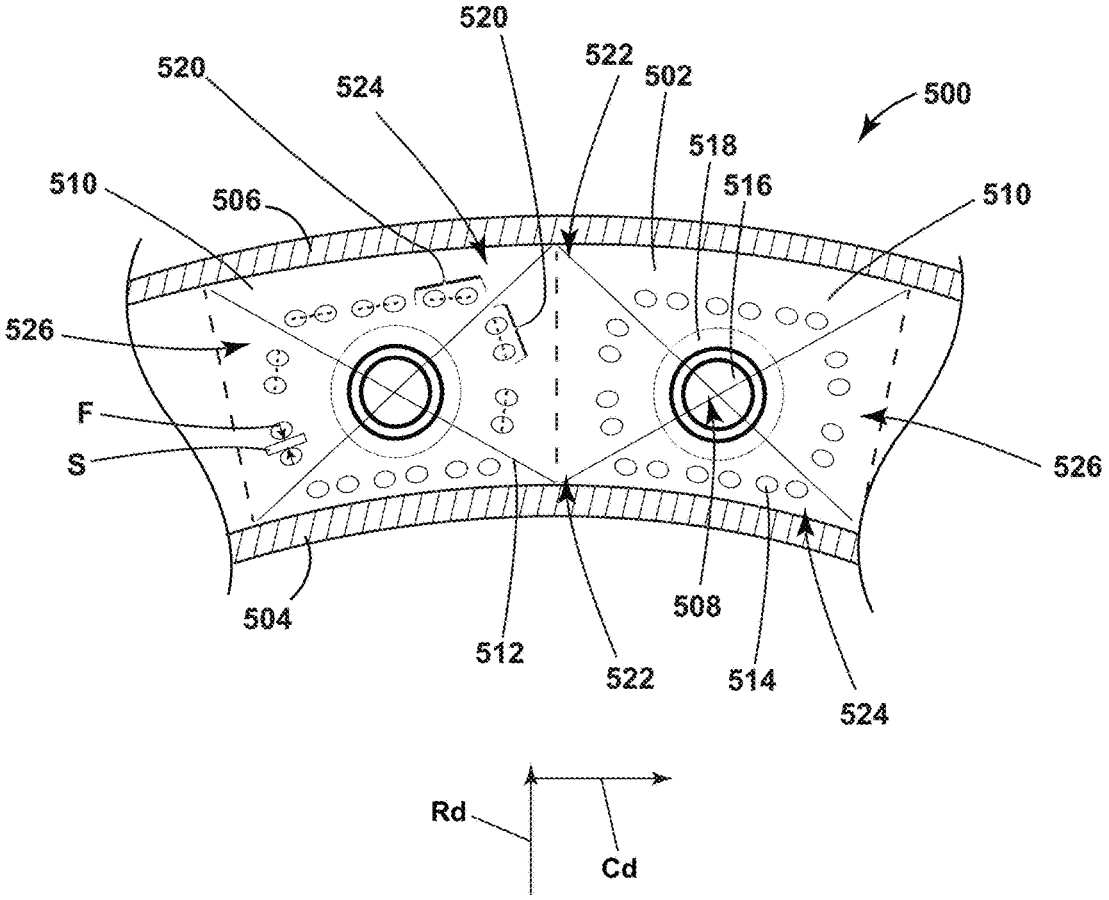
FIG. 13 is an alternative segment of a dome wall, including openings arranged relative to a swirler about the fuel nozzle, in accordance with aspects described herein.

Referring to FIG. 13, another exemplary combustor 500 can include a dome wall 502 having an inner combustor liner 504 and an outer combustor liner 506, with a set of fuel nozzles 508 provided on the dome wall 502. The dome wall 502 can be separated into a set of segments 510, with each segment including one fuel nozzle 508 and a set of openings 514 providing a flow of air F to the combustor 500 through the dome wall 502. A set of lines 512 are shown on the combustor 500 extending between corners 522 of the segments 510, separating the segments 510 into upper and lower sections 524 and side sections 526.

The fuel nozzle 508 can include a fuel outlet 516 with a swirler 518 provided around the fuel outlet 516. The swirler 518 can provide a swirler flow of air, or a fuel-air mixture, which can be used to shape or otherwise contain the flame generated by the fuel outlet 516. Pairs of openings 520 can be provided around, about, or exterior of the swirler 518 to provide a sheet of air S by angling the pairs of openings 520 toward each other. Pairs of openings 520 can be arranged in the upper and lower sections 524, being circumferentially aligned within the upper and lower sections 524. While shown as three pairs of openings 520 in each upper and lower section 524, any number of pairs is contemplated. Each opening 514 of each pair of openings 520 is angled toward one another, forming a sheet of air S. In alternate examples, it is contemplated that the openings within the upper and lower sections 524 are not formed as pairs, and do not intersect to form sheets of air S, while the openings 520 in side sections 526 can remain as pairs forming sheets of air S.

As the corners 522 are arranged furthest from the fuel nozzle 508, stagnation areas can develop at these positions. Stagnation areas can lead to high local temperatures if the gas or fluid within these stagnation areas is not flushed or otherwise moved. The sheets of air S formed by the openings 520 in the side sections 526 can be utilized to flush out the stagnation areas in the corners 522, where the sheet of air S can be more effective than a single opening, as a sheet of air provides for covering an area. It should be understood that the pairs of openings 520 in the side sections 526 can be angled toward one another to form the sheet of air S, while being further angled toward the corners 522 and away from the fuel nozzle 508, thereby flushing the corners 522 without intersecting the sheet of air with the flame, thereby avoiding disturbing of the flame.

Figure 14:
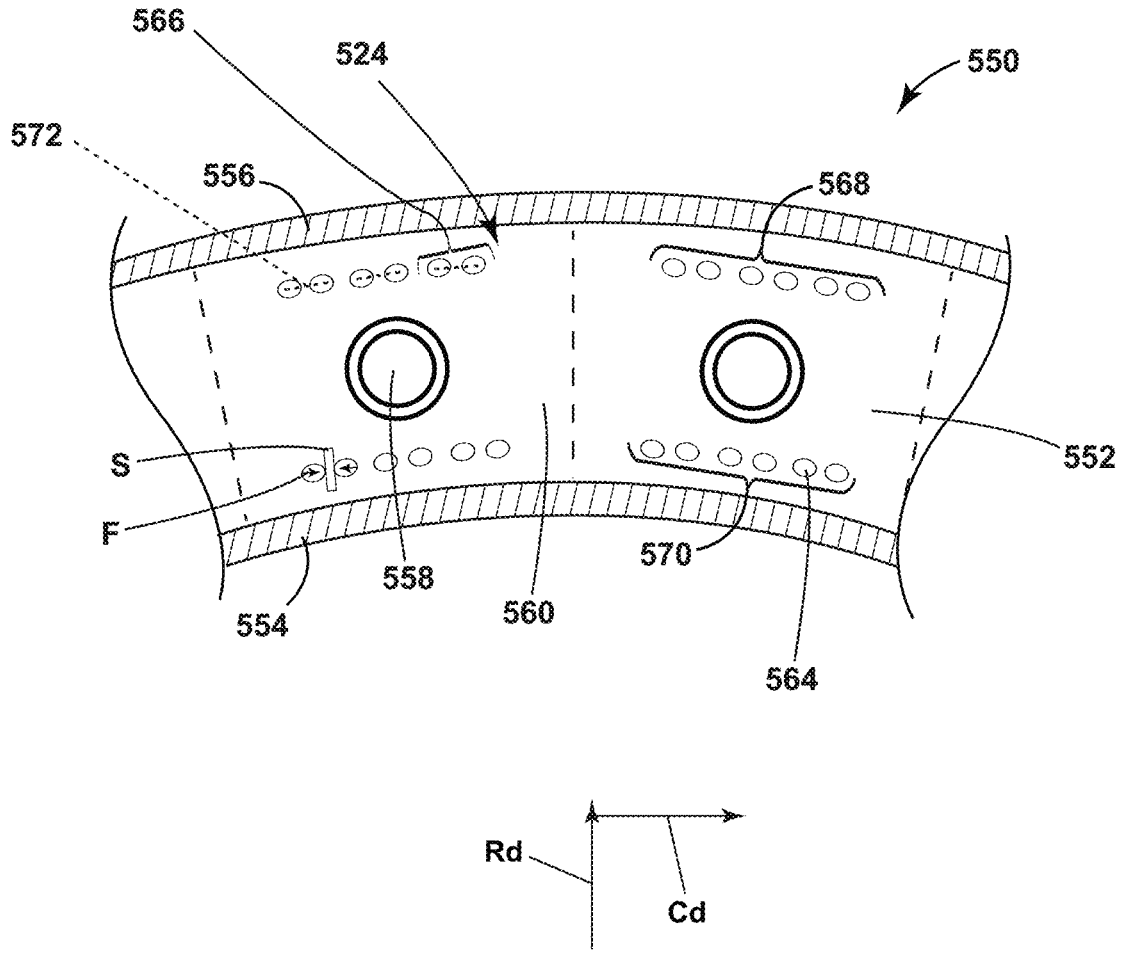
FIG. 14 is an alternative segment of a dome wall, including openings arranged relative to a circumferential direction, in accordance with aspects described herein.

Referring to FIG. 14, another exemplary combustor 550 can include a dome wall 552 having an inner combustor liner 554 and an outer combustor liner 556, with a set of fuel nozzles 558 provided on the dome wall 552. The dome wall 552 can be separated into a set of segments 560, with each segment including one fuel nozzle 558 and a set of openings 564 providing a flow of air F to the combustor 550 through the dome wall 552.

The set of openings 564 is arranged into pairs of openings 566, with the pairs of openings 566 being organized into a radially outer set 568 and a radially inner set 570. Each pair of openings 566 of the radially outer set 568 can include an opening axis 572 that is aligned with the opening axis 572 from an adjacent radially outer set 568, and can be aligned in the circumferential direction (Cd). Similarly, each pair of openings 566 of the radially inner set 570 can include the opening axis 572 that is aligned with the opening axis 572 from an adjacent radially inner set 570.

Such an arrangement can provide for forming sheets of air S extending in the radial and axial directions, thereby having a radial length. The radial length can provide greater resistance to deformation due to the flame, as opposed to only relying on the thickness alone, when the sheet of air is arranged with a plane facing the flame.

Figure 15:
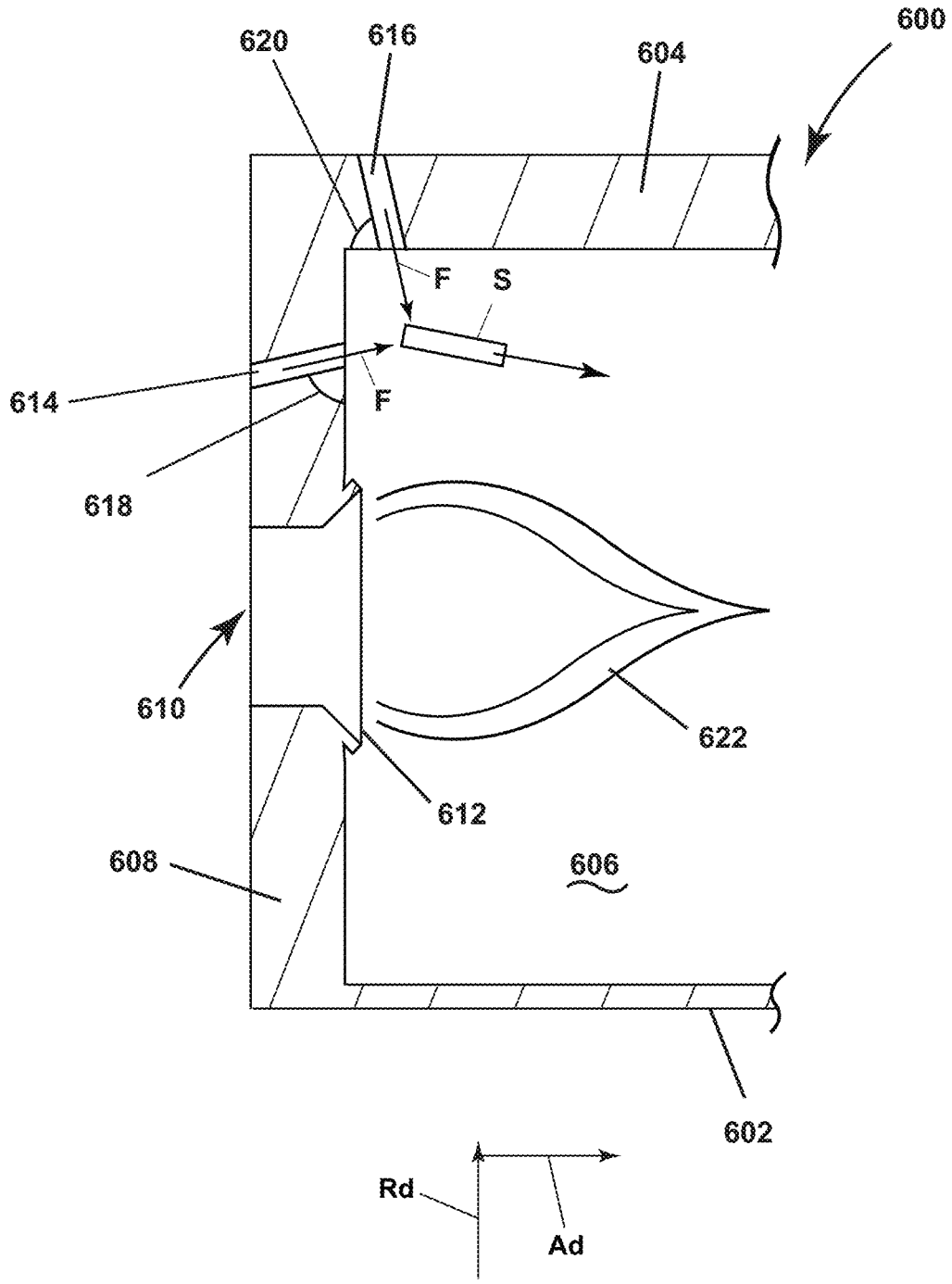
FIG. 15 is a cross-sectional view of an alternative combustion section for use in the gas turbine engine of FIG. 1, illustrating a pair of openings among a dome wall and a combustor liner forming a sheet of air, in accordance with aspects described herein.

FIG. 15 shows a radial, sectional view of another combustor assembly 600, including an inner combustor liner 602 and an outer combustor liner 604 defining a combustion chamber 606 therebetween. A dome wall 608 supports a fuel nozzle assembly 610 having a nozzle 612 opening into the combustion chamber 606 to deliver a fuel to the combustion chamber 606. A first opening 614 can be provided in the dome wall 608 and a second opening 616 can be provided in the outer combustor liner 604, while a similar arrangement between the dome wall 608 and the inner combustor liner 602 is contemplated. Additionally, it is contemplated that the openings are arranged as sets of openings extending in the circumferential direction (Cd), but are not visible in the section view as shown. In another example, it is contemplated that the first and second openings 614, 616 define a pair of openings, or can include a set of pairs of openings defined circumferentially among the dome wall 608 and the outer combustor liner 604. It should be appreciated that while the second opening 616 is shown in the outer combustor liner 604, it is contemplated one or more openings are provided in the inner combustor liner 602.

The first opening 614 and the second opening 616 can be arranged at a first angle 618 and a second angle 620, respectively. The first angle 618 can be defined relative to the radial direction (Rd), or relative to an axis defined along the dome wall 608, and can be between 15-degrees and 135-degrees, for example. The second angle 620 can be defined relative to the axial direction (Ad), or relative to an axis defined along the outer combustor liner 604, and can be between 15-degrees and 135-degrees. The first and second angles 618, 620 can be defined such that the first opening 614 and the second opening 616 are angled toward one another, such that a flow of air F passing through the first and second openings 614, 616 intersects each other or impinges on one another to define a sheet of air S, collectively formed from the flow of air F from the first and second openings 614, 616. The sheet of air S can be formed generally as a plane, and the geometry and orientation of the sheet of air S can be dependent on the sizing, shaping, and flow rates for the flow of air F provided through the first and second openings 614, 616, and by the first and second angles 618, 620. In another example, it is contemplated that the first and second openings 614, 616 can be offset from one another, to form an interlacing air flow field.

Utilizing openings arranged among the dome wall 608 and the combustor liners 602, 604 provide for forming one or more sheets of air S that can utilize a steeper angle for the second opening by utilizing the combustor liners 602, 604, relative to the axial direction (Ad). The steeper angles permitted through the combustor liners 602, 604 can provide for greater ability to determine the position or arrangement of the resultant sheet of air S, without requiring steep angles for openings through the dome wall 608 alone, which can reduce operational inefficiencies resultant of supplying a flow of air F to openings at steeper angles. Using these sheets of air S, one can effectively shape a flame 622 produced by the combustor assembly 600. Controlling the shape of the flame 622 can decrease flame scrubbing on the combustor liners 602, 604 and the dome wall 608, increasing the temperature durability of the combustor assembly 600. Increasing temperature durability permits the use of higher-temperature fuels, such as hydrogen or hydrogen-based fuels, which may otherwise be too hot for the combustor assembly 600. Controlling the flame shape and geometry can increase engine temperature tolerabilities, which can increase overall engine efficiency with more efficient fuels, as well as reducing overall engine emissions through the use of more efficient fuels, like hydrogen fuels, while current or traditional engine combustors would be unable to operate under the harsh conditions or temperatures associated with high-temperature or hydrogen fuels.

Figure 16:
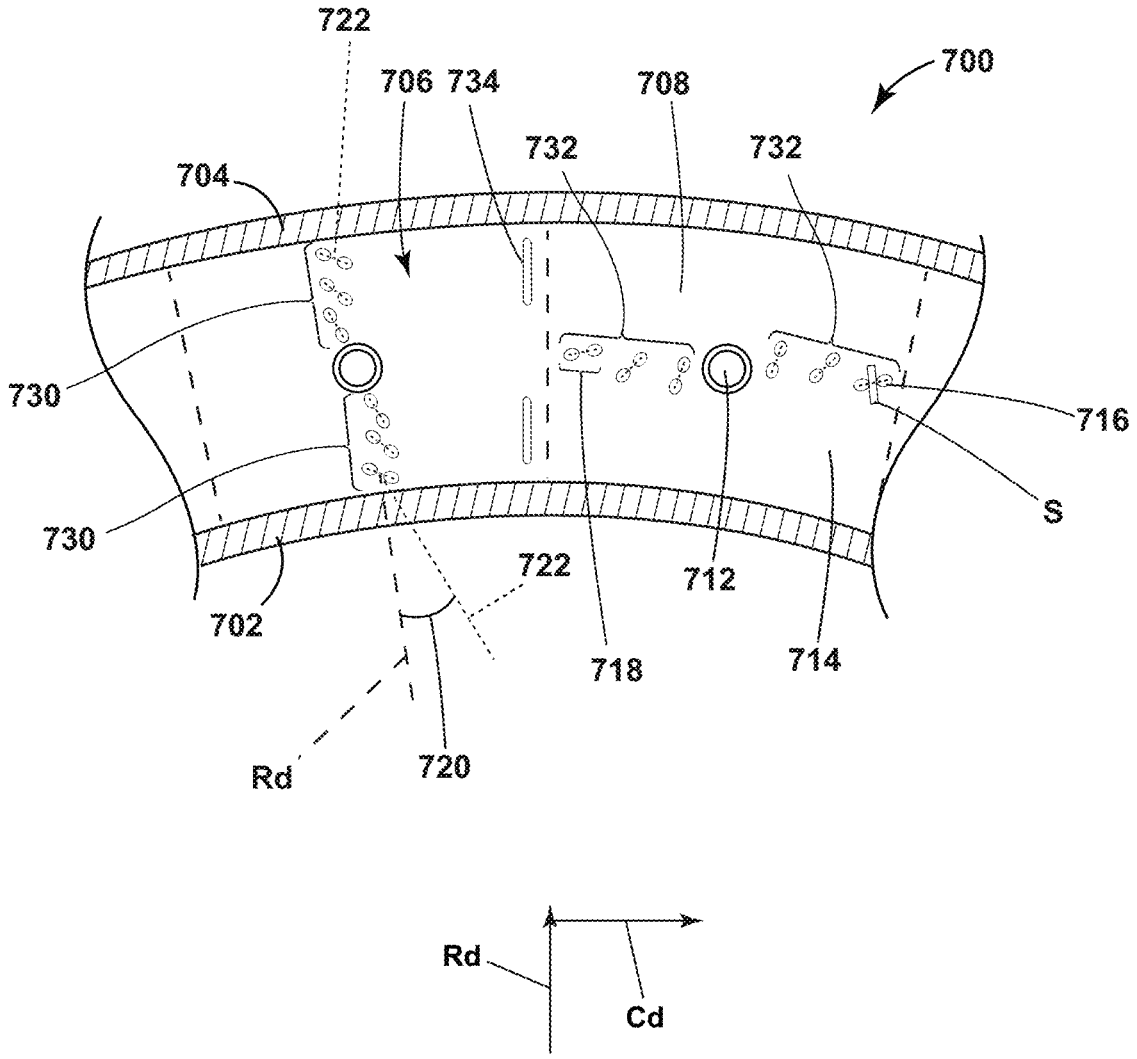
FIG. 16 is a cross-sectional view of an alternative combustion section for use in the gas turbine engine of FIG. 1, illustrating pairs of openings with a varying angle arranging the pairs of openings relative to distance from a fuel nozzle, in accordance with aspects described herein.

Referring to FIG. 16, shows a radial, sectional view of another combustor assembly 700, including an inner combustor liner 702 and an outer combustor liner 704 defining a combustion chamber 706 therebetween. A dome wall 708 supports a set of fuel nozzles 712 opening into the combustion chamber 706 to deliver a fuel to the combustion chamber 706. The dome wall 708 can be separated into a set of segments 714, with each segment 714 including one fuel nozzle 712 and a set of openings 716 extending through the dome wall 708.

The set of openings 716 are arranged into pairs of openings 718, with the pairs of openings 718 oriented such that a flow path streamline for one opening intersects a flow path streamline for the other opening for each pair of openings 718 within the set of openings 716. Additionally, each pair of openings 718 can define an angle 720. The angle 720 can be defined by a pair axis 722, which can be defined as extending between centers the pair of openings 718. The angle 720 can be defined along a plane defined by a combination of a radial direction (Rd) and an axial direction (Ad), or by a plane defined along the dome wall 708. The angle 720 can be defined relative to the radial direction (Rd). That is, each pair of openings 718 defining the pair axis 722 that defines the angle 720, is measured in a radial-axial plane (Rd, Ad), relative to the radial direction (Rd).

The angle 720 can vary relative to proximity to the fuel nozzle 712, while variation due to proximity to other features is contemplated, such as a combustor liner 702, 704 or adjacent segment 714 in non-limiting examples. As distance from the fuel nozzle 712 increases for the pair of openings 718, the angle 720 can increase or decrease. As can be appreciated in FIG. 16, openings are arranged into radially-extending sets 730 and circumferentially-extending sets 732. It is further contemplated that the radially-extending sets 730 need not necessarily be between the fuel nozzle 712 and the combustor liners 702, 704, and can be positioned at a greater distance from the fuel nozzle 712 measured in the radial direction (Rd) than a lesser distance from the fuel nozzle 712 measured in the circumferential direction (Cd), for example. Similarly, the circumferentially-extending sets 732 need not be between the fuel nozzle 712 and an adjacent fuel nozzle 712, and can extend at a greater distance from the fuel nozzle 712 measured in the circumferential direction (Cd) than the radial direction (Rd).

The radially-extending sets 730 can include a decreasing value for the angle 720 as distance from the fuel nozzle 712 increases. That is, the nearer that the pairs of openings 718 of the radially-extending sets 730 are to the fuel nozzle 712, the lesser the value of the angle 720. The pairs of openings 718 for the radially-extending sets 730 are positioned between the fuel nozzle 712 and either of the inner or outer combustor liners 702, 704, or radially above or below the fuel nozzle 712, in order to provide a sheet of air S between a flame emitted from the fuel nozzle 712 and the inner or outer combustor liners 702, 704. In this way, the radially-extending sets 730 provide for maintaining a shape of a flame generated from a fuel nozzle or shielding portions of the inner and outer combustor liners 702, 704 from the produced flame, as well as tailoring the orientation of the sheet of air S for each pair of openings 718 to the position on the dome wall 708. For example, as the pairs of openings 718 near the inner or outer combustor liners 702, 704, it may be beneficial to orient the sheets of air S to shield a larger area of the inner or outer combustor liners 702, 704. Increasing the angle 720 can orient the sheet of air S to be more parallel to the inner or outer combustor liners 702, 704 the nearer the pair of openings 718 is to the inner or outer combustor liners 702, 704. Similarly, the relatively lesser angle 720 nearer to the fuel nozzle 712 more closely matches the shape of the flame. Therefore, the pairs of openings 718 can be oriented based upon position or relation to the fuel nozzle 712 or combustor liners 702, 704, which can be used to tailor the orientation of the sheet of air S to the local environment, thereby providing greater flame durability for the entire combustor assembly 700.

The circumferentially-extending sets 732 can be defined by decreasing the angle 720 as the distance from the fuel nozzle 712 to the pair of openings 718 increases. That is, the nearer that the pairs of openings 718 of the circumferentially-extending sets 732 are to the fuel nozzle 712, the greater the value of the angle 720. The pairs of openings 718 for the circumferentially-extending sets 732 position between fuel nozzles 712 among adjacent segments 714, or circumferentially to the side of the fuel nozzle 712 at a greater distance than radially above or below the fuel nozzle 712, in order to provide a sheet of air S between flames emitted from the fuel nozzle 712 among adjacent fuel nozzles 712 and segments 714. In this way, the circumferentially-extending sets 732 creates a sheet of air S positioned to maintain a shape of a flame generated from the fuel nozzle 712 or shielding adjacent flames from one another, as well as tailoring the orientation of the sheet of air S to the produced flame. For the pairs of openings 718 between adjacent fuel nozzles 712, it may be beneficial to orient the sheets of air S to shield a larger area of space between the adjacent fuel nozzles 712, by orienting the sheet of air parallel to or almost parallel to the radial direction (Rd). Decreasing the angle 720 can orient the sheet of air S to be more parallel to the radial direction (Rd), thereby shielding a greater area between adjacent fuel nozzles 712. Similarly, the relatively larger angle 720 nearer to the fuel nozzle 712 more closely matches the shape of the produced flame. Therefore, the pairs of openings 718 can be oriented based upon position or relation to the fuel nozzle 712, which can be used to tailor the orientation of the sheet of air S to the local environment, thereby providing greater flame durability for the entire combustor assembly 700.

Furthermore, it is contemplated that there are additional slots 734 extending through the dome wall 708. The slots 734 can be elongated, relative to the set of openings 716, and can be positioned near or at the junction between adjacent segments 714. The slots 734 can be oriented such that the elongated arrangement extends in or aligns with the radial direction (Rd). The slots 734 can provide for purging areas of the dome wall 708 where stagnation may otherwise develop, such as at areas without the set of openings 716. It should be understood that the orientation and position for the slots 734 is exemplary, and can be provided at any position on the dome wall 708, with any orientation, as may be beneficial to purge stagnation areas of the combustor assembly 700 at the dome wall 708.

It should be understood that a plurality of combinations is contemplated, such as using one or more pairs of openings or one or more sets thereof, to define one or more sheets of air S for maintaining a shape of a flame generated from a fuel nozzle or shielding portions of the combustor from the flame and resultant temperatures. Shaping the flame or otherwise maintaining its position can reduce flame scrubbing on the combustor liners, as well as the dome wall and other portions of the combustor assembly, which can increase component lifetime, or even permit the use of higher-temperature fuels, such as hydrogen fuels. Such fuels can increase engine efficiency, while reducing emissions.

It should be further understood that a plurality of combinations is contemplated, such as using one or more pairs of openings to define one or more sheets of air. The particular geometry, position, sizing, flow rate, or other attributes of the sheets of air can be discretely defined utilizing pairs of openings that are arranged toward one another so that a flow of air passing through the openings intersects one another, defining the sheet of air. The angle, cross-sectional area, or other orientation or geometry for the openings defining the pairs of openings can be used to define the particular geometry, position, sizing, flow rate, or other attributes for the sheet of air. In this way, it should be understood that features from one aspect can be combined, interchanged, or otherwise organized with features from another aspect. For example, the arrangements of the openings described in FIG. 7 could be applied to the aspects of the other openings described herein, defining a particular geometry for individual pairs of openings in order to develop a complex air profile formed by one or more sheets of air.

Benefits of the present disclosure include greater control of a flame, or shape thereof, formed within the combustion chamber. Greater flame control can reduce flame scrubbing and temperatures along the combustor liners and the dome wall, increasing combustor durability against higher temperatures than previously capable. Resulting benefits include increased time on wing with less maintenance, capability of use of hydrogen fuels or other high-temperature fuels, capability of reducing engine emissions with use of hydrogen or high-temperature fuels.

Benefits of the present disclosure further include improved stagnation flushing from areas of the combustor. Utilizing sheets of air S can improve penetration into stagnation areas, such as at corners of adjacent segments of the dome wall. Improved flushing of stagnation reduces the temperatures required to be borne by portions of the combustor, thereby permitting the use of higher-temperature fuels, such as hydrogen fuels.

Benefits of the present disclosure further include a combustor suitable for use with a hydrogen-containing fuel. As outlined previously, hydrogen-containing fuels have a higher flame temperature than traditional fuels (e.g., fuels not containing hydrogen). That is, hydrogen or a hydrogen mixed fuel typically has a wider flammable range and a faster burning velocity than traditional fuels such petroleum-based fuels, or petroleum and synthetic fuel blends. These high burn temperatures of hydrogen-containing fuel mean that additional insulation is needed between the ignited hydrogen-containing fuel and surrounding components of the gas turbine engine (e.g., the dome wall, the inner/outer liner, and other parts of the gas turbine engine). The combustor, as described herein, includes the plurality of openings that create a layer of fluid insulation (e.g., the sheets S or curtains of compressed air) between the ignited hydrogen-containing fuel and the dome wall, the inner liner, the outer liner, and any portions of the gas turbine engine outside of the dome wall, the inner liner and the outer liner. The curtain of compressed air is further used to shape the flame within the combustion chamber, which in turn results in an enhanced control of the flame shape profile. By shaping the flame, the liner wall temperature, the dome wall temperature, the combustor exit temperature profile and pattern of the flame/gas exiting the combustor can be controlled. This control or shaping can further ensure that the combustion section or otherwise hot sections of the turbine engine do not fail or otherwise become ineffective by being overly heated, thus increasing the lifespan of the turbine engine. Further, the introduction of the dilution passage arrangements, as described herein, ensure an even, uniform, or otherwise desired flame propagation within the combustor.

Benefits associated with using hydrogen-containing fuel over conventional fuels include an eco-friendlier engine as the hydrogen-containing fuel, when combusted, generates less carbon pollutants than a combustor using conventional fuels. For example, a combustor including 100% hydrogen-containing fuel (e.g., the fuel is 100% H2) would have zero carbon pollutants. The combustor, as described herein, can be used in instances where 100% hydrogen-containing fuel is used.

Further benefits associated with using hydrogen-containing fuel over conventional fuels include a gas turbine engine that can utilize less fuel due to higher heating value of fuel to achieve same turbine inlet temperatures. For example, a conventional gas turbine engine using conventional fuels will require less fuel to produce the same amount of work or engine output as the present gas turbine engine using hydrogen-containing fuels and having a leaner flame. This, in turn, means that either less amount of fuel can be used to generate the same amount of engine output as a conventional gas turbine engine, or the same amount of fuel can be used to generate an excess of increased engine output when compared to the conventional gas turbine engine.

To the extent not already described, the different features and structures of the various embodiments can be used in combination, or in substitution with each other as desired. That one feature is not illustrated in all of the embodiments is not meant to be construed that it cannot be so illustrated, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Further aspects are provided by the subject matter of the following clauses:

A gas turbine engine comprising: a compressor section, combustor section, and turbine section defining an engine rotational axis, the combustor section comprising: a combustor liner at least partially defining a combustor chamber; a dome wall, coupled to the combustor liner, and defining a forward end of the combustion chamber; a first fuel nozzle located on the dome wall and fluidly coupled to the combustion chamber; a first opening emitting air into the combustion chamber along a first flow path streamline; and a second opening emitting air into the combustion chamber along a second flow path streamline; wherein the first flow path streamline intersects the second flow path streamline at an intersection point to form a sheet of air.

The gas turbine engine of any preceding clause wherein the intersection point is positioned at a distance from the dome wall.

The gas turbine engine of any preceding clause wherein the distance is less than ten times a maximum cross-sectional distance for the first opening or the second opening.

The gas turbine engine of any preceding clause wherein the first opening is part of a first set of openings and the second opening is part of a second set of openings.

The gas turbine engine of any preceding clause wherein each opening of the first set of openings is radially aligned with another opening of the first set of openings, relative to the engine rotational axis, and wherein each opening of the second set of openings is radially aligned with another opening of the second set of openings.

The gas turbine engine of any preceding clause wherein the first set of openings is offset from the second sets of openings in at least one of a radial direction or a circumferential direction defined relative to the engine rotational axis.

The gas turbine engine of any preceding clause wherein the first set of openings and second set of openings each include multiple pairs of openings, with each pair of openings forming a corresponding sheet of air, which collectively form a set of sheets of air.

The gas turbine engine of any preceding clause wherein the set of sheets of air comprises at least one sheet of air radially above the first fuel nozzle and at least one sheet of air radially below the first fuel nozzle.

The gas turbine engine of any preceding clause wherein the set of sheets of air comprises at least one sheet of air on a first circumferential side of the first fuel nozzle and at least one sheet of air on a second circumferential side, opposite the first circumferential side.

The gas turbine engine of any preceding clause wherein the dome wall includes a set of dome wall segments, with each dome wall segment including one fuel nozzle, where each segment can be divided into sections, with each section including a corner, and wherein the set of sheets of air comprises at least one sheet of air located in each corner.

The gas turbine engine of any preceding clause wherein the dome wall includes a set of dome wall segments, wherein the first opening is provided in a first segment of the set of dome wall segments, and the second opening is provided in an adjacent second segment of the set of dome wall segments.

The gas turbine engine of any preceding clause wherein the dome wall includes a set of dome wall segments, wherein at least one of the first opening and the second opening spans adjacent segments of the set of dome wall segments.

The gas turbine engine of any preceding clause further comprising a second fuel nozzle, circumferentially spaced from the first fuel nozzle, and the sheet of air is located circumferentially between the first and second fuel nozzles.

The gas turbine engine of any preceding clause wherein at least one set of the first opening and the second opening is located in the dome wall.

The gas turbine engine of any preceding clause wherein at least one of the first opening and the second opening is located in the combustor liner.

The gas turbine engine of any preceding clause wherein the sheet of air is arranged perpendicular to a common plane common to both of the first flow path streamline and the second flow path streamline.

The gas turbine engine of any preceding clause wherein the multiple pairs of openings include a pair axis extending between each pair of openings of the multiple pairs of openings, and wherein the pair axis for each pair of openings is arranged at an angle relative to a radial direction extending perpendicular to the engine rotational axis.

The gas turbine engine of any preceding clause herein the angle for each pair of openings increases as a distance from each pair of openings from the fuel nozzle increases.

The gas turbine engine of any preceding clause wherein the multiple pairs of openings are arranged radially interior or exterior of the first fuel nozzle.

The gas turbine engine of any preceding clause wherein the angle for each pair of openings decreases as a distance from each pair of openings from the fuel nozzle increases.

The gas turbine engine of any preceding clause wherein the multiple pairs of openings are arranged circumferentially between the first fuel nozzle and an adjacent second fuel nozzle.

The gas turbine engine of any preceding clause further comprising a set of slots provided in the dome wall.

The gas turbine engine of any preceding clause wherein the set of slots are elongated in a radial direction defined perpendicular to the engine rotational axis.

The gas turbine of any preceding clause further comprising a swirler around the first fuel nozzle.

The gas turbine engine of any preceding clause wherein the multiple pairs of openings are arranged about the swirler.

The gas turbine engine of any preceding clause wherein at least some pairs of openings of the multiple pairs of openings are arranged in an upper section above the first fuel nozzle and at least some pairs of openings of the multiple pairs of openings are arranged in a lower section below the first fuel nozzle.

The gas turbine engine of any preceding clause wherein at least some pairs of openings of the multiple pairs of openings are arranged in a corner of a segment of the dome wall.

A gas turbine engine comprising: a compressor section, combustor section, and turbine section defining an engine rotational axis, the combustor section comprising: a combustor liner at least partially defining a combustor chamber; a dome wall, coupled to the combustor liner, and defining a forward end of the combustion chamber; a first fuel nozzle located on the dome wall and fluidly coupled to the combustion chamber; a first set of openings emitting air into the combustion chamber along a first flow path streamline; and a second set of openings emitting air into the combustion chamber along a second flow path streamline; wherein the first flow path streamline for each opening of the first set of openings is interlaced with the second flow path streamline for each opening of the second set of openings.

The gas turbine engine of any preceding clause wherein each opening of the first set of openings is radially offset from each opening of the second set of openings.

The gas turbine engine of any preceding clause wherein each opening of the first set of openings is circumferentially offset from each opening of the second set of openings.

The gas turbine engine of any preceding clause wherein the interlaced flow among the first set of openings and the second set of openings collectively form a sheet of air.

A combustor for a gas turbine engine defining an engine rotational axis, the combustor comprising: an annular combustor liner at least partially encasing a combustion chamber; a dome wall coupled to the annular combustor liner, the dome wall at least partially defining the combustion chamber; at least one fuel nozzle located on the dome wall and fluidly coupled to the combustion chamber; and a set of openings at least partially provided in the dome wall wherein each opening of the set of openings defines a flow path streamline and wherein the flow path streamline of each opening of the set of openings intersects another flow path streamline for another opening of the set of openings to form a sheet of air at the intersection of the flow path streamlines.

The combustor of any preceding clause wherein the set of openings further includes a first set and a second set, and wherein the openings in the first set are radially aligned, the second set are radially aligned, and the openings in the first set are circumferentially offset from the openings in the second set.

The combustor of any preceding clause wherein the set of openings are further arranged into pairs of openings, wherein each pair of openings is oriented such that a first flow path streamline for a first opening of the pair of openings intersects a second flow path streamline for a second opening of the pair of openings.

The combustor of any preceding clause wherein the pairs of openings include at least one opening from the first set and one at least one opening from the second set.

A gas turbine engine comprising: an engine core including a compressor section, a combustor section, and a turbine section in serial flow arrangement and defining an engine centerline, the combustor comprising: a combustor liner at least partially encasing a combustion chamber, a dome wall coupled to the combustor liner, and defining a forward end of the combustion chamber, at least one fuel nozzle located on the dome wall and fluidly coupled to the combustion chamber, and compressed air openings located in the dome wall wherein each opening from the compressed air openings defines a corresponding flow path streamline, and the compressed air openings are oriented such that the flow path streamlines intersect when projected onto a common plane.

The gas turbine engine of any preceding clause wherein the flow path streamlines intersect at an intersection point relative to the common plane, and wherein the intersection point is spaced from the dome wall by less than ten times the maximum width of one opening of the compressed air openings.

The gas turbine engine of any preceding clause wherein the dome wall is arranged as a set of segments.

The gas turbine engine of any preceding clause wherein the compressed air openings are arranged as a first set and a second set, and wherein the first set is provided in a first segment of the set of segments, and the second set is provided on an adjacent second segment of the set of segments.

The gas turbine engine of any preceding clause wherein the compressed air openings in the first set are radially aligned.

The gas turbine engine of any preceding clause wherein the compressed air openings are circumferentially aligned.

The gas turbine engine of any preceding clause wherein the compressed air openings are arranged into pairs, wherein each opening in each pair is oriented such that the flow path streamlines of each pair intersect when projected onto a common plane.

The gas turbine engine of any preceding wherein the compressed air openings include multiple pairs of first and second compressed air openings, with each compressed air opening of each pair are oriented such that the flow path streamlines intersect when projected onto the common plane.

The gas turbine engine of any preceding clause wherein the multiple pairs are arranged as sets of two pairs, wherein each pair defines a flow path streamline that intersect when projected onto the common plane, and wherein the common plane for a first pair of the set of two pairs is perpendicular to a second pair of the set of two pairs.

The gas turbine engine of any preceding wherein the dome wall includes a set of dome wall segments, with each dome wall segment including a fuel nozzle, where each segment can be divided into sections, with each section including a corner, and wherein the set of local air curtains comprises at least one air curtain located in each corner.

The gas turbine engine of any preceding clause wherein the compressed air openings are provided either radially interior or radially exterior of the fuel nozzle.

The gas turbine engine of any preceding clause wherein the compressed air openings are arranged circumferentially between adjacent fuel nozzles.

The gas turbine engine of any preceding clause wherein each opening of the first set is offset from each opening of the second set.

The gas turbine engine of any preceding clause wherein the offset between the first set and the second set is in the circumferential direction.

The gas turbine engine of any preceding clause wherein one opening of the compressed air openings includes a greater cross-sectional area than another opening of the compressed air openings.

The gas turbine engine of any preceding clause wherein one opening of the compressed air openings includes a greater flow rate than another opening of the compressed air openings.

The gas turbine engine of any preceding clause wherein the flow path streamline of one opening of the compressed air openings is angularly offset from the common plane, while the flow path streamline of another opening extends along the common plane.

A method of controlling a flame emitted from a fuel nozzle for a combustor of a gas turbine engine defining an engine rotational axis, the combustor including a dome wall with a set of openings extending through the dome wall, the dome wall at least partially defining a combustion chamber, the method comprising: flowing a flow of air through the set of openings; and intersecting the flow of air within the combustion chamber and spaced from the dome wall;

wherein the intersection of the intersecting flow of air forms a sheet of air extending into the combustion chamber.

The method of any preceding clause wherein the set of openings includes at least one pair of openings, and wherein each opening of the at least one pair of openings is angled toward the other opening of the at least one pair of openings such flowing the flow of air through the pair of openings results in the intersecting of the flow of air within the combustion chamber.

The method of any preceding clause wherein a flow rate for the flow of air through one opening of the at least one pair of openings is greater than a flow rate for the flow of air through the other opening of the at least one pair of openings.

The method of any preceding clause wherein the at least one pair of openings are arranged to form the sheet of air between the flame and a combustor liner at least partially defining the combustion chamber.

What is claimed is:

1. A gas turbine engine comprising:

a compressor section, combustor section, and turbine section defining an engine rotational axis, the combustor section comprising:

a combustor liner at least partially defining a combustion chamber;

a dome wall, coupled to the combustor liner, and defining a forward end of the combustion chamber;

a fuel nozzle located on the dome wall and fluidly coupled to the combustion chamber;

a first set of openings provided in the dome wall with each opening of the first set of openings configured to emit air into the combustion chamber along a first flow path streamline; and a second set of openings provided in the dome wall with each opening of the second set of openings configured to emit air into the combustion chamber along a second flow path streamline;

wherein the first flow path streamline intersects the second flow path streamline at an intersection point; and wherein the first set of openings are aligned in circumferential arrangement at a first common radius about the engine rotational axis and the second set of openings are aligned in circumferential arrangement at a second common radius about the engine rotational axis.

2. The gas turbine engine of claim 1, wherein the first set of openings are radially unaligned with the second set of openings.

3. The gas turbine engine of claim 1, wherein each opening of the first set of openings is aligned with one opening of the second set of openings defined in a radial direction relative to the engine rotational axis.

4. A combustor for a turbine engine defining an engine rotational axis, the combustor comprising:

a dome wall;

a fuel nozzle located on the dome wall;

a first opening provided in the dome wall configured to emit air along a first flow path streamline; and a second opening provided in the dome wall configured to emit air along a second flow path streamline;

wherein the first flow path streamline intersects the second flow path streamline at an intersection point; and wherein the first opening and the second opening are aligned in circumferential arrangement at a common radius about the engine rotational axis.

5. The combustor of claim 4, wherein the first opening is unaligned with the second opening in a radial direction relative to the engine rotational axis.

6. A gas turbine engine comprising:

a compressor section, combustor section, and turbine section defining an engine rotational axis, the combustor section comprising:

a combustor liner at least partially defining a combustion chamber;

a dome wall, coupled to the combustor liner, and defining a forward end of the combustion chamber;

a fuel nozzle located on the dome wall and fluidly coupled to the combustion chamber;

a first set of openings provided in the dome wall with each opening of the first set of openings configured to emit air into the combustion chamber along a first flow path streamline; and a second set of openings provided in the dome wall with each opening of the second set of openings configured to emit air into the combustion chamber along a second flow path streamline;

wherein the first flow path streamline intersects the second flow path streamline at an intersection point;

wherein each opening of the first set of openings is paired with one opening of the second set of openings to define pairs of openings, and wherein each pair of openings includes the first flow path streamline that intersects the second flow path streamline at the intersection point; and wherein a first pair of openings of the pairs of openings defines a first opening axis and a second pair of openings of the pairs of openings defines a second opening axis, and wherein the first pair of openings and the second pair of openings are arranged such that the first opening axis is arranged perpendicular to and intersecting the second opening axis.

7. The gas turbine engine of claim 6, wherein at least one pair of openings of the first pair of openings or the second pair of openings spans adjacent segments of the dome wall.

8. A gas turbine engine comprising:

a compressor section, combustor section, and turbine section defining an engine rotational axis, the combustor section comprising:

a combustor liner at least partially defining a combustion chamber;

a dome wall, coupled to the combustor liner, and defining a forward end of the combustion chamber;

a fuel nozzle located on the dome wall and fluidly coupled to the combustion chamber;

a first set of openings provided in the dome wall with each opening of the first set of openings configured to emit air into the combustion chamber along a first flow path streamline; and a second set of openings provided in the dome wall with each opening of the second set of openings configured to emit air into the combustion chamber along a second flow path streamline;

wherein the first flow path streamline intersects the second flow path streamline at an intersection point;

wherein each opening of the first set of openings is paired with one opening of the second set of openings to define pairs of openings, and wherein each pair of openings includes the first flow path streamline that intersects the second flow path streamline at the intersection point;

wherein each pair of openings includes a radially inner opening and a radially outer opening, and wherein the radially inner opening is radially offset from the radially outer opening for each pair of openings relative to a radial axis extending from the engine rotational axis; and wherein at least some openings of the pairs of openings are positioned radially interior of the fuel nozzle and at least some openings of the pairs of openings are positioned radially exterior of the fuel nozzle relative to the radial axis extending from the engine rotational axis.

9. A gas turbine engine comprising:

a compressor section, combustor section, and turbine section defining an engine rotational axis, the combustor section comprising:

a combustor liner at least partially defining a combustion chamber;

a dome wall, coupled to the combustor liner, and defining a forward end of the combustion chamber;

a fuel nozzle located on the dome wall and fluidly coupled to the combustion chamber;

a first set of openings provided in the dome wall with each opening of the first set of openings configured to emit air into the combustion chamber along a first flow path streamline; and a second set of openings provided in the dome wall with each opening of the second set of openings configured to emit air into the combustion chamber along a second flow path streamline;

wherein the first flow path streamline intersects the second flow path streamline at an intersection point;

wherein each opening of the first set of openings is paired with one opening of the second set of openings to define pairs of openings, and wherein each pair of openings includes the first flow path streamline that intersects the second flow path streamline at the intersection point; and wherein the pairs of openings are aligned in a circumferential direction defined relative to the engine rotational axis.

10. A gas turbine engine comprising:

a compressor section, combustor section, and turbine section defining an engine rotational axis, the combustor section comprising:

a combustor liner at least partially defining a combustion chamber;

a dome wall, coupled to the combustor liner, and defining a forward end of the combustion chamber;

a fuel nozzle located on the dome wall and fluidly coupled to the combustion chamber;

a first set of openings provided in the dome wall with each opening of the first set of openings configured to emit air into the combustion chamber along a first flow path streamline; and a second set of openings provided in the dome wall with each opening of the second set of openings configured to emit air into the combustion chamber along a second flow path streamline;

wherein the first flow path streamline intersects the second flow path streamline at an intersection point;

wherein each opening of the first set of openings is paired with one opening of the second set of openings to define pairs of openings, and wherein each pair of openings includes the first flow path streamline that intersects the second flow path streamline at the intersection point; and wherein at least some pairs of openings are positioned radially exterior of the fuel nozzle and at least some pairs of openings are positioned radially interior of the fuel nozzle.

11. A gas turbine engine comprising:

a compressor section, combustor section, and turbine section defining an engine rotational axis, the combustor section comprising:

a combustor liner at least partially defining a combustion chamber;

a dome wall, coupled to the combustor liner, and defining a forward end of the combustion chamber;

a fuel nozzle located on the dome wall and fluidly coupled to the combustion chamber;

a first set of openings provided in the dome wall with each opening of the first set of openings configured to emit air into the combustion chamber along a first flow path streamline; and a second set of openings provided in the dome wall with each opening of the second set of openings configured to emit air into the combustion chamber along a second flow path streamline;

wherein the first flow path streamline intersects the second flow path streamline at an intersection point;

wherein each opening of the first set of openings is paired with one opening of the second set of openings to define pairs of openings, and wherein each pair of openings includes the first flow path streamline that intersects the second flow path streamline at the intersection point; and wherein each pair of openings includes a pair axis defining an angle relative to a radial axis extending from the engine rotational axis and wherein the pair axis for the pairs of openings varies based upon distance of the pairs of openings from the fuel nozzle.

12. The gas turbine engine of claim 11, wherein the angle increases for the pairs of openings as distance from the fuel nozzle increases.

* * * * *